US006021286A

United States Patent [19]

Kawai et al.

[11] Patent Number: 6,021,286

[45] Date of Patent: Feb. 1, 2000

[54] IMAGE FORMING APPARATUS

[75] Inventors: Tsutomu Kawai; Masakazu Kinoshita; Hidenori Fujioka, all of Kato-gun; Hitohiro Maeda, Kawasaki, all of Japan

[73] Assignee: Fujitsu Limited, Kawasaki, Japan

[21] Appl. No.: 09/140,798

[22] Filed: Aug. 26, 1998

[30] Foreign Application Priority Data

Nov. 27, 1997 [JP] Japan ..... 9-326810

[51] Int. Cl.[7] ..... G03G 15/16

[52] U.S. Cl. ..... 399/45; 399/66; 399/299

[58] Field of Search ..... 399/66, 297, 298, 399/299, 303, 312, 313, 314, 45

[56] References Cited

U.S. PATENT DOCUMENTS

| | | | |
|---|---|---|---|
| 5,041,877 | 8/1991 | Matsumoto . | |
| 5,469,248 | 11/1995 | Fujiwara et al. | 355/326 R |
| 5,794,110 | 8/1998 | Kasai et al. | 399/299 |

FOREIGN PATENT DOCUMENTS

| | | |
|---|---|---|
| 2-178685 | 7/1990 | Japan . |
| 2-304585 | 12/1990 | Japan . |
| 6-27837 | 2/1994 | Japan . |
| 6-266177 | 9/1994 | Japan . |
| 6-289686 | 10/1994 | Japan . |
| 9-6153 | 1/1997 | Japan . |
| 9-127803 | 5/1997 | Japan . |

OTHER PUBLICATIONS

U.S. Patent Application S.N. 09/042,806 filed: Mar. 17, 1998, entitled Image Forming Apparatus, inventors: Youji Houki et al.

*Primary Examiner*—Richard Moses

*Attorney, Agent, or Firm*—Armstrong, Westerman, Hattori, McLeland & Naughton

[57] ABSTRACT

A developing portion forms a toner image, which corresponds to a recording image, with a toner which has been electrically charged to a predetermined electrical potential. A transfer portion, to which an electric potential, different from the electric potential of the toner image, is applied, transfers the toner image onto a recording medium. A first transfer-electric-potential applying portion applies a transfer electric potential to the transfer portion. A carrying portion carries the recording medium so as to cause the recording medium to pass by the transfer portion. A second transfer-electric-potential applying portion sets the recording medium and the carrying portion to cause the recording medium and the carrying portion to have a predetermined electric potential corresponding to the transfer electric potential of the transfer portion.

22 Claims, 19 Drawing Sheets

FIG. 10

| | | LEVELS OF SELECTION SIGNALS | |
|---|---|---|---|
| RECORDING MODE | RECORDING MEDIUM | VTCS1 | VTCS2 |
| COLOR | ORDINARY PAPER (OBVERSE SIDE) | L | L |
| COLOR | FILM FOR OHP | L | H |
| COLOR | ORDINARY PAPER (REVERSE SIDE) | H | L |
| MONOCHROME | ——— | H | H |

FIG. 12

| | LEVELS OF SELECTION SIGNALS | | OUTPUT VOLTAGES | | | | | |
|---|---|---|---|---|---|---|---|---|
| OUTPUT MODE | VTCS1 | VTCS2 | VBJ | VBT | VTY | VTM | VTC | VTK |
| COLOR, ORDINARY PAPER, OBVERSE SIDE | L | L | VBJ1 | VBT1 | VTY1 | VTM1 | VTC1 | VTK1 |
| FILM FOR OHP | L | H | VBJ2 | VBT2 | VTY2 | VTM2 | VTC2 | VTK2 |
| COLOR, ORDINARY PAPER, REVERSE SIDE | H | L | VBJ1 | VBT1 | VTY3 | VTM3 | VTC3 | VTK3 |
| MONOCHROME | H | H | VBJ3 | VBT3 | OFF | OFF | OFF | VTK4 |

FIG. 15

| | POTENTIAL OF BELT BEFORE TRANSFER IS PERFORMED (V) | | | |
|---|---|---|---|---|
| POTENTIAL OF BELT AFTER ELECTRIC-CHARGE REMOVAL IS PERFORMED (V) | VBC=0V | VBC=1000V | VBC=2000V | VBC=3000V |
| 400 | 500 | 850 | 1350 | 1900 |
| 900 | 890 | 950 | 1400 | 2100 |
| 1380 | 950 | 1330 | 1900 | 2300 |
| 1800 | 1300 | 1650 | 2250 | 2600 |
| 2100 | 1350 | 1900 | 2450 | 2800 |
| 2500 | 1700 | 2100 | 2500 | 2950 |

IMAGE FORMING APPARATUS

BACKGROUND OF THE INVENTION

1. Field of the Invention

The present invention relates to an image forming apparatus, and, in particular, to an image forming apparatus for forming an image electrostatically.

In an image forming apparatus using the electrophotographic recording method for performing color printing, toners having a plurality of colors such as yellow, cyan, magenta and black are transferred onto a recording medium so as to be overlaid on each other so that color printing is performed. At this time, the toners are powder and may scatter so as to stain recording paper and/or the apparatus as transfer dust. Therefore, it is necessary to reduce scattering of the transfer dust.

2. Descriptions of the Related Art

FIG. 1 shows a general arrangement of one example of the related art.

A color printer 100 using the electrophotographic recording method includes electrostatic recording units 102-1 through 102-4 for four colors: yellow (Y), magenta (M), cyan (C) and black (K), for electrostatically recording a toner image, a fixing unit 103 for fixing a color image, recorded onto a recording paper 101, recorded by the electrostatic recording units for the four colors, on the recording paper 101, and a carrying mechanism 104 for carrying the recording paper 101.

The recording paper 101 is drawn out from a hopper 105 by the carrying mechanism 104, and is carried to the recording units 102-1 through 102-4 for the four colors. The electrostatic recording units 102-1 through 102-4 for the four colors are disposed in the direction (the direction of the arrow C) in which the recording paper 101 is carried tandem, and transfer the toners of the four colors onto the recording paper 101 so as to be overlaid on each other sequentially.

The recording paper 101 is carried in the direction of the arrow C by the carrying mechanism 104, and, is supplied to the fixing unit 103 after the toners of the four colors are transferred onto the recording paper 101 in the order of yellow (Y), magenta (M), cyan (C) and black (K) by the respective electrostatic recording units 102-1 through 102-4.

The fixing unit 103 fixes the toners, transferred onto the recording paper 101 by the electrostatic recording units 102-1 through 102-4 for the four colors, by means of heating and pressing. The recording paper 101, on which the toners have been fixed by the fixing unit 103, is further carried by the carrying mechanism 104 and is stacked on a stacker 106.

FIG.2 shows a general arrangement of the electrostatic recording unit in one example of the related art.

Each of the electrostatic recording units 102-1 through 102-4 for the four colors includes a photosensitive drum 107 on which an electrostatic latent image corresponding to a recording image is formed, an electric charger 108 for electrically charging the photosensitive drum 107 uniformly, an LED array 109 for irradiating the photosensitive drum 107, which has been electrically charged uniformly, in accordance with the recording image, a developer 110 for developing the electrostatic latent image formed on the photosensitive drum 107 using the toner, and a transfer roller 111 for transferring the toner image developed by the developer 110 on the photosensitive drum 107 into the recording paper 101.

At this time, in the electrostatic recording units 102-1 through 102-4 in the related art, in order to improve the toner transfer efficiency for transferring the developed image onto the recording paper, the polarity of the electric potential of the transfer roller 111 is set to be reverse of the polarity of the electric potential of the toners.

Further, the electric potential of the transfer roller 111 is set to be the same between the electrostatic recording units 102-1 through 102-4.

Thereby, for example, when the toner is transferred so as to be overlaid on the previously transferred toner on the recording paper by the electrostatic recording unit, the tone of the currently transferred toner is lowered due to the influence of the previously transferred toner. Further, because a distance occurs between the photosensitive drum 107 and the recording paper 101, unnecessary toner is transferred onto the recording paper 101, that is, the transfer dust occurs. Thereby, the printing quality is degraded.

SUMMARY OF THE INVENTION

The present invention has been devised in consideration of the above-mentioned problems, and, an object of the present invention is to provide an image forming apparatus in which the transfer dust is reduced, unevenness in the tone for each color is prevented from occurring, and thereby, the printing quality can be improved.

An image forming apparatus, according to the present invention, comprises:

- developing means for forming a toner image, which corresponds to a recording image, with a toner which has been electrically charged to a predetermined electrical potential;
- transfer means, to which an electric potential, different from the electric potential of the toner image, is applied, for transferring the toner image onto a recording medium;
- first transfer-electric-potential applying means for applying a transfer electric potential to the transfer means;
- carrying means for carrying the recording medium so as to cause the recording medium to pass by the transfer means; and
- a second transfer-electric-potential applying means for setting the recording medium and the carrying means to cause the recording medium and the carrying means to have a predetermined electric potential corresponding to the transfer electric potential of the transfer means.

In this arrangement, because the general transfer voltage is determined by the first and second transfer-electric-potential applying means, it is possible to set the transfer electric potential of the transfer means to a low value. Thereby, occurrence of electric-current leakage, generation of ozone, or the like can be prevented.

The first transfer-electric-potential A applying means may set the transfer electric potential of a polarity the same as the polarity of the toner.

In this arrangement, it is possible to set the transfer electric potential of the transfer means to a low value. Thereby, occurrence of electric-current leakage, generation of ozone, or the like, which may occur when the transfer electric potential of the transfer means is large, can be prevented.

The forming apparatus may comprises electric potential control means for controlling, in accordance with the resistance of the recording medium, the transfer electric potential which is applied to the transfer means by the first transfer-electric-potential applying means and the predetermined electric potential which is applied to the recording medium and the carrying means by the second transfer-electric-potential applying means.

When the type of the recording medium is different, the electrically charged electric potential of the carrying means after the transfer is different. In this arrangement, in a case where printing is repeated, different transfer electric potentials are used for various types of recording media. As a result, by changing the transfer electric potential through the transfer-electric-potential control means, it is possible to use the electric potential to be applied to the transfer means suitable for each type of a recording medium.

The second transfer-electric-potential applying means may comprise:

electric-charge removing means for removing the electric charges from the carrying means;

electric charging means for electrically charging the carrying means from which the electric charges have been removed by the electric-charge removing means, and electrically charging the recording medium; and electric-charging control means for controlling the electric-charge removal electric potential of the electric-charge removing means and the electric-charging electric potential of the electric charging means.

In this arrangement, by controlling the electric-charging electric potential of the electric charging means and the electric-charge removal electric potential of the electric-charge removing means, it is possible to set the electrically charged electric potential of the recording medium and the carrying means.

The electric charging control means may cause the electric potential of the carrying means to have a different electric potential in accordance with whether the volume resistivity of the recording medium is lower than $10^{14}$ (Ω) or is equal to or higher than $10^{14}$ (Ω).

In this arrangement, in accordance with whether the volume resistivity of the recording medium is lower than $10^{14}$ (Ω) or is equal to or higher than $10^{14}$ (Ω), that is, whether the recording medium is ordinary paper or a film for an OHP, the transfer electric potential is controlled. Thereby, it is possible to set the transfer electric potentials suitable for ordinary paper and a film for an OHP, respectively. As a result, it is possible to improve the quality of a transferred image.

The electric charging control means may cause the carrying means to be electrically charged so that the surface electric-charge density thereof is equal to or higher than 620 ($\mu C/m^2$) when the volume resistivity of the recording medium is lower than $10^{14}$ (Ω), and the electric charging control means may cause the carrying means to be electrically charged so that the surface electric-charge density thereof is equal to or higher than 1178 ($\mu C/m^2$) when the volume resistivity of the recording medium is equal to or higher than $10^{14}$ (Ω).

In this arrangement, when the volume resistivity of the recording medium is lower than $10^{14}$ Ω, that is, when the recording medium is ordinary paper, the carrying means is electrically charged to have the surface electric-charge density equal to or higher than 620 $\mu C/m^2$. When the volume resistivity of the recording medium is equal to or higher than $10^{14}$ Ω, that is, when the recording medium is a film for an OHP, the carrying means is electrically charged to have the surface electric-charge density equal to or higher than 1178 $\mu C/m^2$. Thereby, it is possible to set the transfer electric potentials suitable for ordinary paper and a film for an OHP, respectively. As a result, it is possible to improve the quality of a transferred image.

An image forming apparatus, according to another aspect of the present invention, comprises:

a plurality of recording units, each comprising:

developing means for forming a toner image corresponding to a recording image with a toner charged to have a predetermined electric potential; and transfer means, which faces the developing means via a recording medium and to which an electric potential different from the electric potential of the toner image is applied, for transferring the toner image onto the recording medium, the plurality of recording units transferring the plurality of toner images onto the recording medium so as that the plurality of toner images are overlaid on each other;

fixing means for fixing the plurality of toner images transferred onto the recording medium so that the plurality of toner images are overlaid on each other; and transfer-electric-potential applying means in which the electric potentials to be applied to the transfer means of the plurality of recording units are set such that the difference between the electric potential of the transfer means and the electric potential of the toner increases sequentially in the order of the arrangement of the plurality of recording units.

In this arrangement, the difference between the electric potential of the transfer means and the electric potential of the toner is larger in the recording unit which performs the transfer later. Thereby, it is possible to perform the transfer of the toner without being subject to the influence of the previously transferred toner. As a result, it is possible to surely transfer the toner on the previously transferred toner. Consequently, the quality of the thus-formed image can be improved.

The transfer-electric-potential applying means may comprise:

first transfer-electric-potential applying means for applying a transfer electric potential to the transfer means; and second transfer-electric-potential applying means for setting the recording medium and the carrying means so as to cause the recording medium and carrying means to have a predetermined electric potential suitable for the transfer electric potential of the transfer means.

In this arrangement, the general transfer electric potential is determined by the first and second transfer-electric-potential applying means. As a result, it is possible to set the transfer electric potential of each transfer means to be low. Thereby, it is not necessary to set the transfer electric potential of the transfer means of the recording unit which performs the transfer later to be very high. As a result, electric current leakage, ozone generation or the like, which occurs due to a very high electric potential of the transfer voltage, can be prevented.

The image forming apparatus may further comprise electric potential control means for controlling, in accordance with the resistance of the recording medium, the transfer electric potential which is applied to the transfer means by the first transfer-electric-potential applying means and the predetermined electric potential which is applied to the recording medium and the carrying means by the second transfer-electric-potential applying means.

When the type of the recording medium is different, the electrically charged electric potential of the carrying means after the transfer is different. In the above-described arrangement, different transfer electric potentials are used for various types of recording media. As a result, when the printing is repeated, by appropriately changing the transfer electric potential through the transfer-electric-potential control means, it is possible to use the electric potential to be applied to the transfer means suitable for each type of a recording medium.

The second transfer-electric-potential applying means may comprise:

electric-charge removing means for removing the electric charges from the carrying means;

electric charging means for charging the carrying means for electrically charging,the carrying means from which the electric charges have been removed by the electric-charge removing means, and electrically charging the recording medium; and electric charging control means for controlling the electric-charge removal electric potential of the electric-charge removing means and the electric charging electric potential of the electric charging means.

In this arrangement, by controlling the electric-charging electric potential of the electric charging means and the electric-charge removal electric potential of the electric-charge removing means, it is possible to set the electrically charged electric potential of the recording medium and the carrying means.

The electric charging control means may cause the electric potential of the carrying means to have a different electric potential in accordance with whether the volume resistivity of the recording medium is lower than $10^{14}$ (Ω) or is equal to or higher than $10^{14}$ (Ω).

In this arrangement, in accordance with whether the volume resistivity of the recording medium is lower than $10^{14}$ (Ω) or is equal to or higher than $10^{14}$ (Ω), that is, whether the recording medium is ordinary paper or a film for an OHP, the transfer electric potential is controlled. Thereby, it is possible to set the transfer electric potentials suitable for ordinary paper and a film for an OHP, respectively. As a result, it is possible to improve the quality of a transferred image.

The electric charging control means may cause the carrying means to be electrically charged so that the surface electric-charge density thereof is equal to or higher than 620 ($\mu C/m^2$) when the volume resistivity of the recording medium is lower than $10^{14}$ (Ω), and the electric charging control means may cause the carrying means to be electrically charged so that the surface electric-charge density thereof is equal to or higher than 1178 ($\mu C/m^2$) when the volume resistivity of the recording medium is equal to or higher than $10^{14}$ (Ω).

In this arrangement, when the volume resistivity of the recording medium is lower than $10^{14}$ Ω, that is, when the recording medium is ordinary paper, the carrying means is electrically charged to have the surface electric-charge density of equal to or higher than 620 $\mu C/m^2$. When the volume resistivity of the recording medium is equal to or higher than $10^{14}$ Ω, that is, when the recording medium is a film for an OHP, the carrying means is electrically charged to have the surface electric-charge density of equal to or higher than 1178 $\mu C/m^2$. Thereby, it is possible to set the transfer electric potentials suitable for ordinary paper and a film for an OHP, respectively. As a result, it is possible to improve the quality of a transferred image.

Other objects and further features of the present invention will become more apparent from the following detailed description when read in conjunction with the accompanying drawings.

BRIEF DESCRIPTIONS OF THE DRAWINGS

FIG. 10 illustrates levels of selection signals with respect to recording modes and types of recording media in the embodiment of the present invention;

FIG. 12 shows output voltages of the power supply board with respect to the levels of the selection signals in the embodiment of the present invention;

FIG. 15 shows the characteristics of the electric potential of an endless belt before transfer is performed with respect to the electric potential of the endless belt after electric-charge removal is performed on the endless belt by an electric-charge removing brush and the electric charging voltage applied by an electric charging roller;

Figure 16:
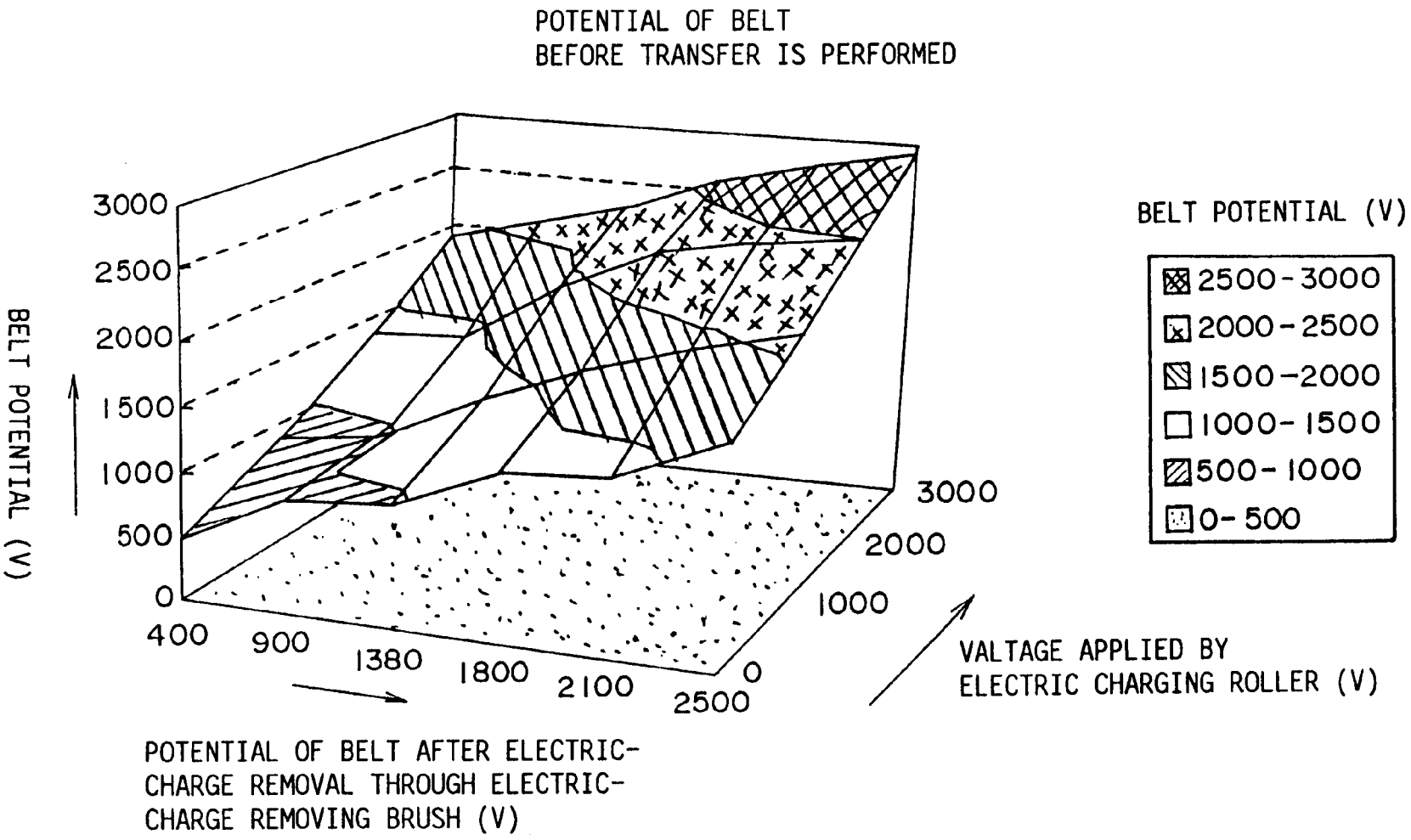
Figure 17:
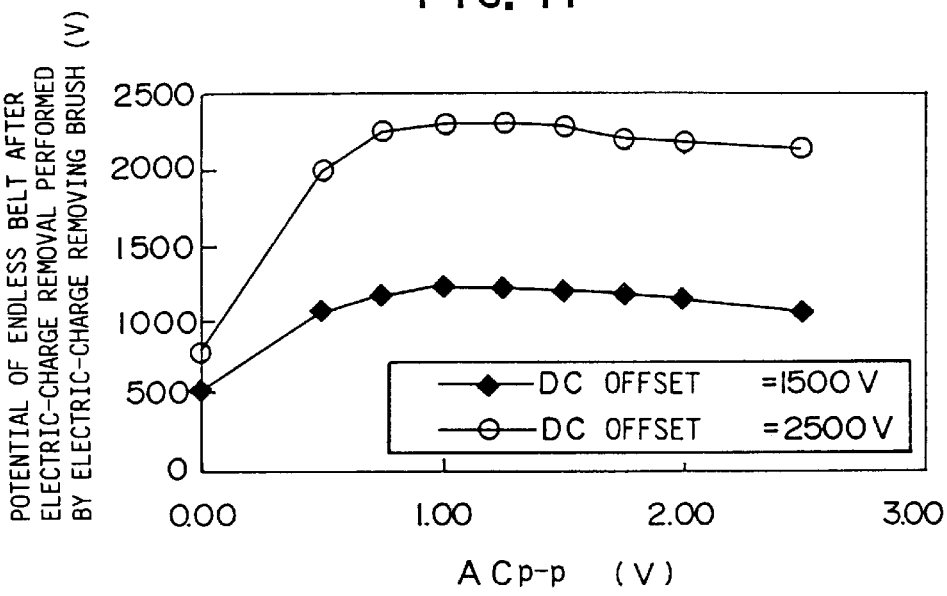
Figure 18:
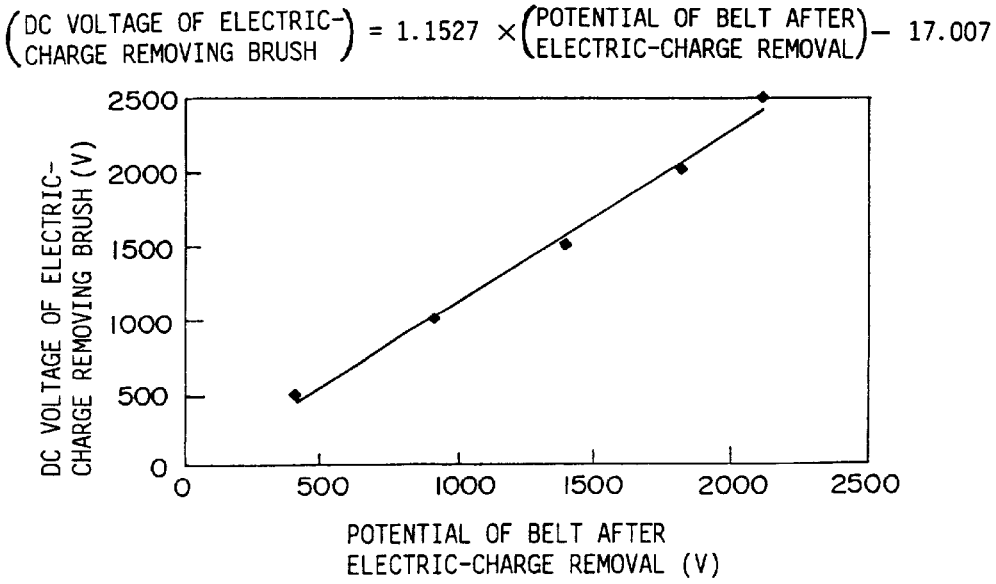
Figure 19A:
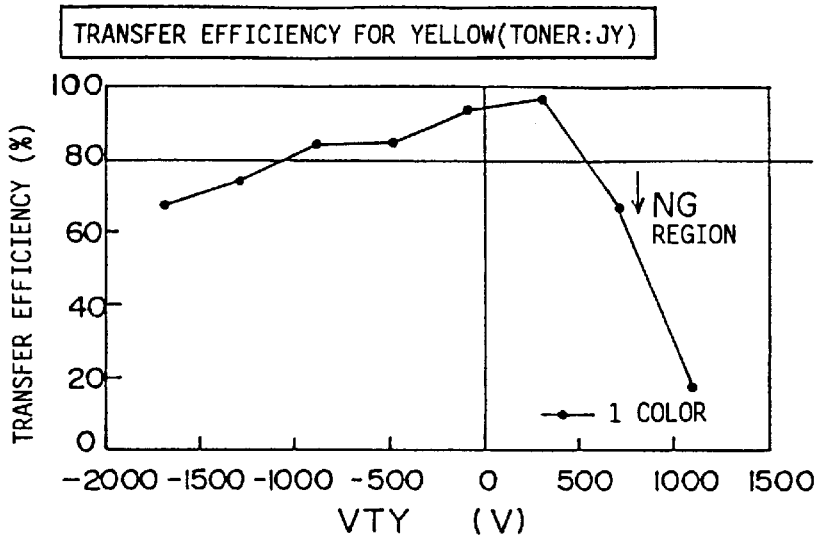
Figure 19B:
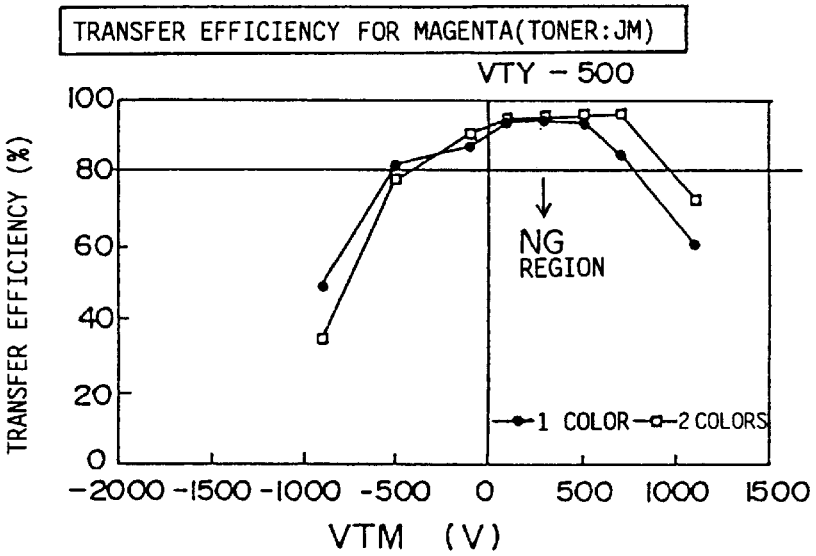
Figure 19C:
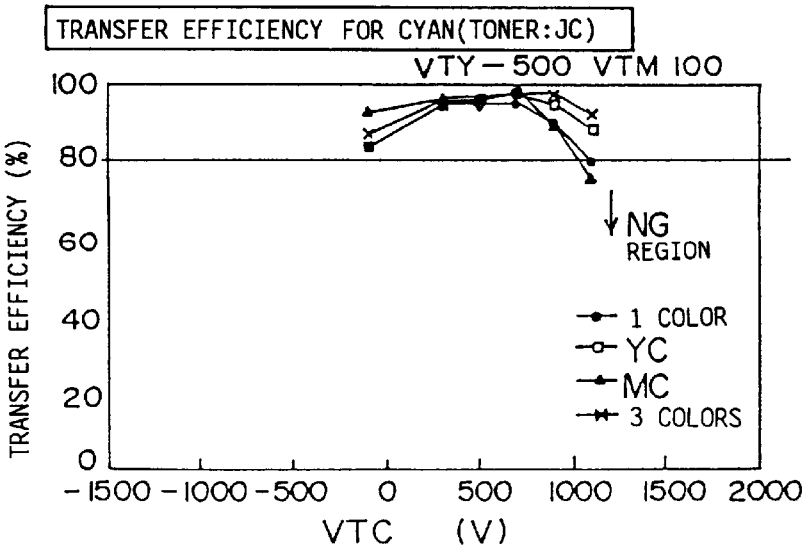
Figure 20A:
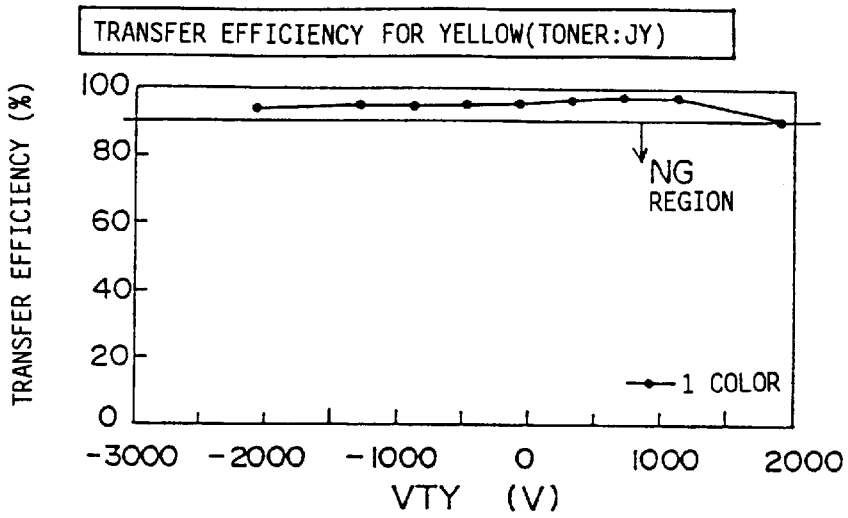
Figure 20B:
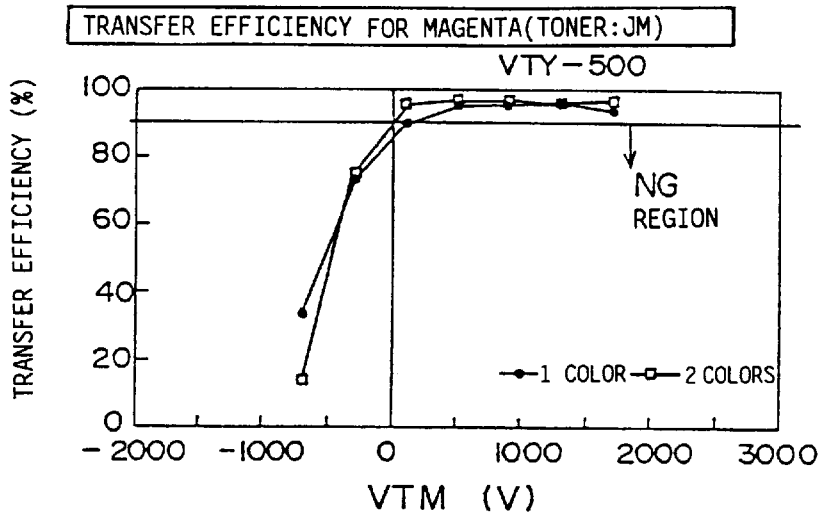
Figure 20C:
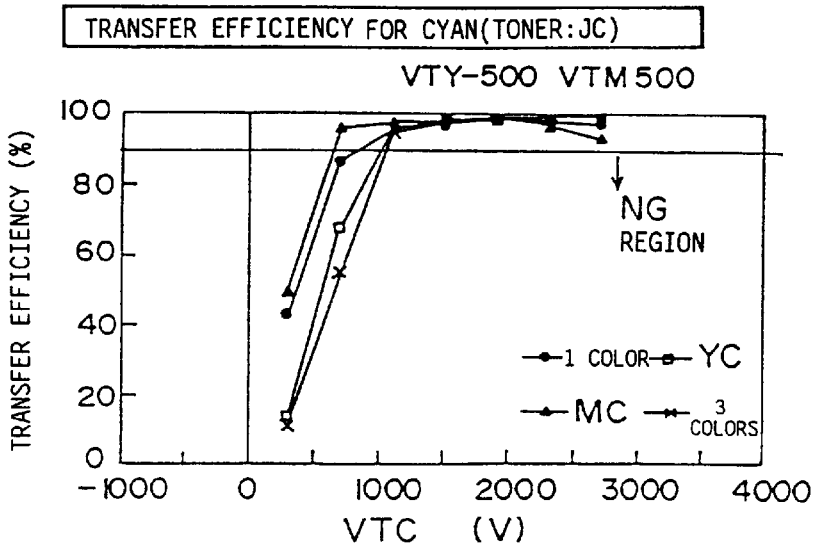

FIG. 16 also shows the characteristics of the electric potential of the endless belt before the transfer is performed with respect to the electric potential of the endless belt after the electric-charge removal is performed on the endless belt by the electric-charge removing brush and the electric charging voltage applied by the electric charging roller;

FIG. 17 shows the characteristics of the electric potential of the endless belt after the electric-charge removal is performed by the electric-charge removing brush with respect to ACp-p;

FIG. 18 shows the characteristics of a DC voltage used in the electric-charge removal with respect to the electric potential of the endless belt after the electric-charge removal is performed by the electric-charge removing brush;

FIGS. 19A, 19B and 19C show the characteristics of transfer efficiencies with respect to transfer voltages when the printing is performed on ordinary paper; and FIGS. 20A, 20B and 20C show the characteristics of transfer efficiencies with respect to transfer voltages when the printing is performed on a film for an OHP.

DETAILED DESCRIPTIONS OF THE PREFERRED EMBODIMENT

A general arrangement of an image forming apparatus in one embodiment of the present invention will now be described.

Figure 1:
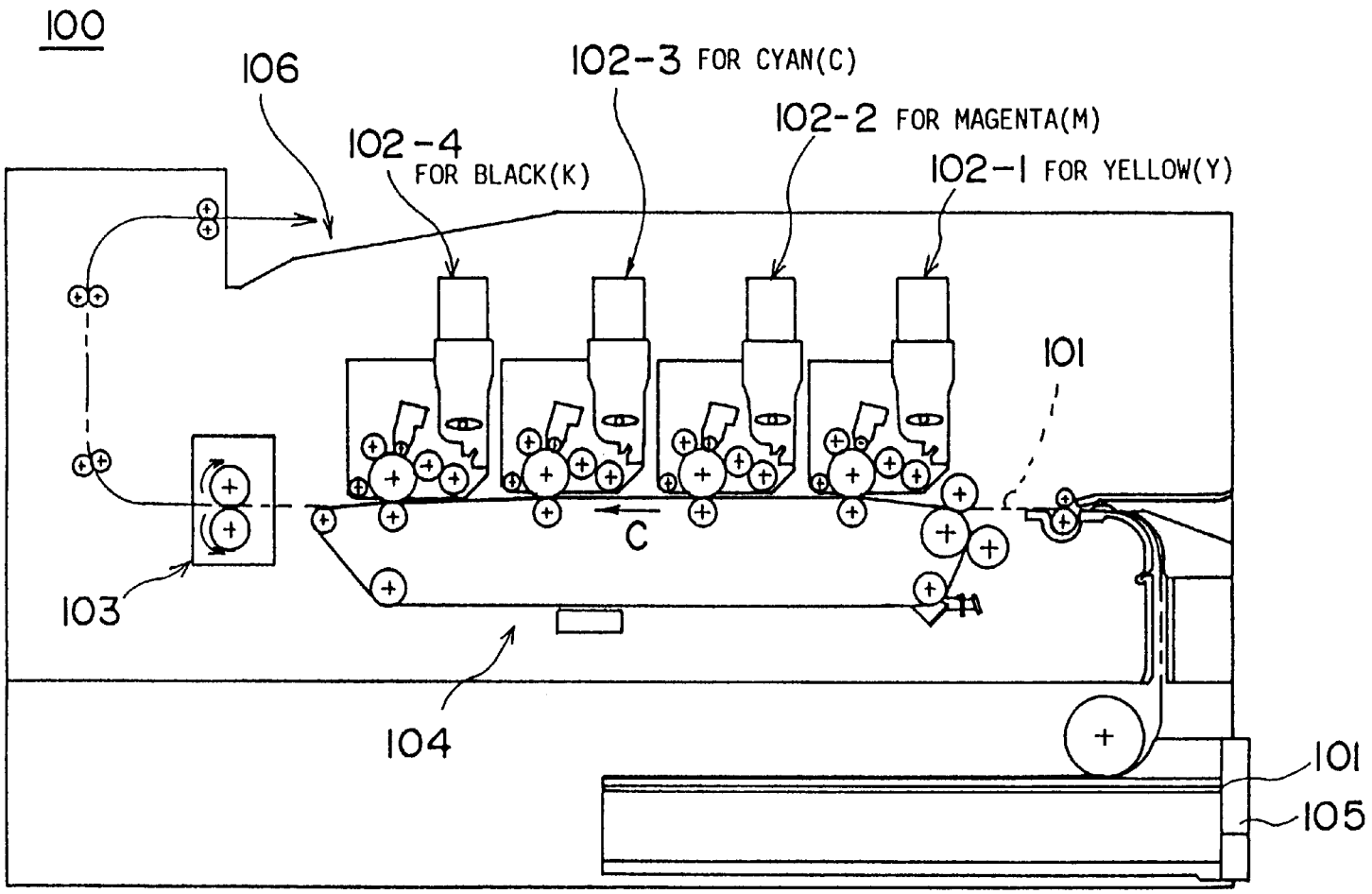
FIG. 1 shows a general arrangement of one example of the related art.
Figure 2:
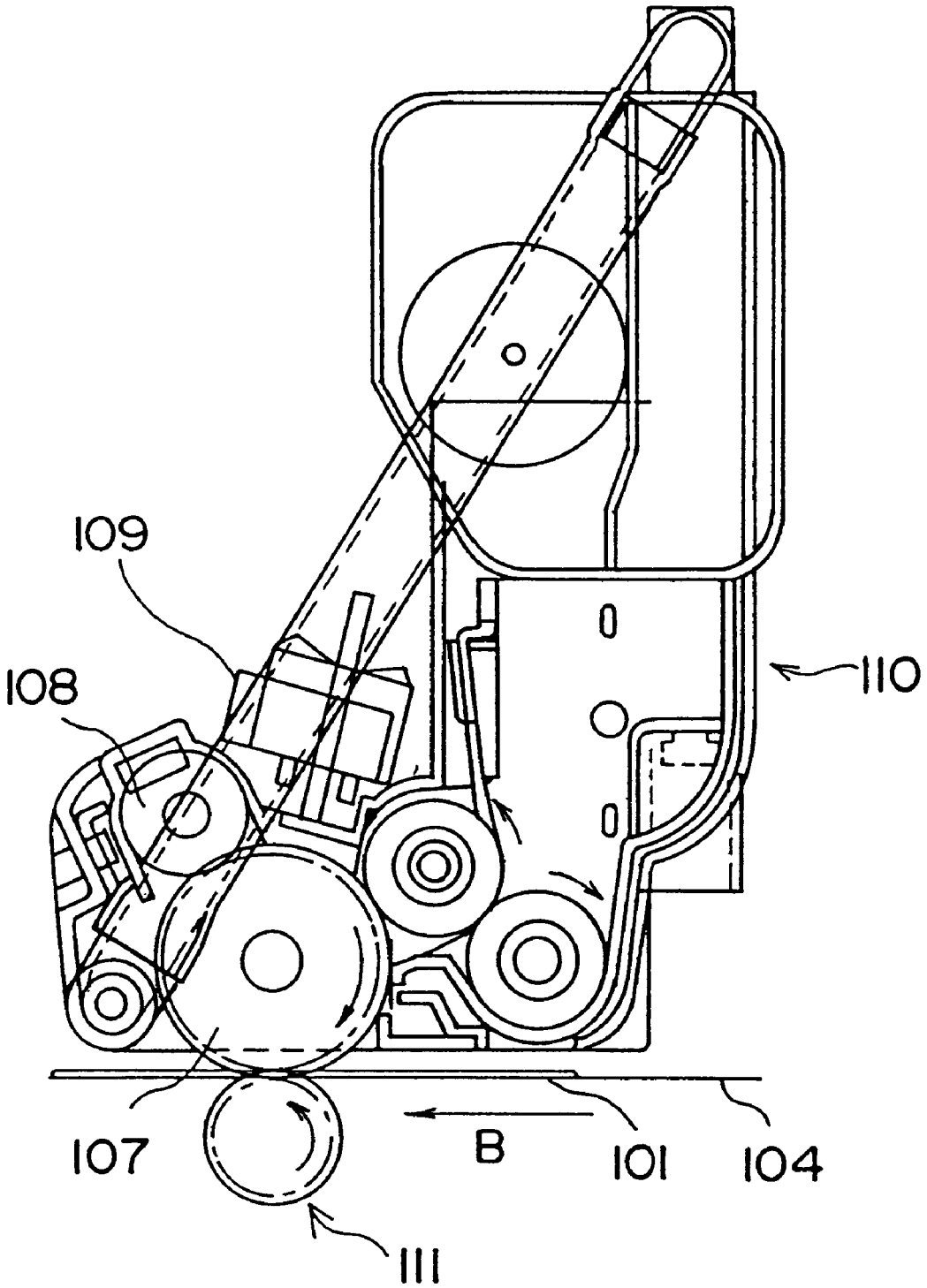
FIG. 2 shows a general arrangement of an electrostatic recording unit in the example of the related art.
Figure 3:
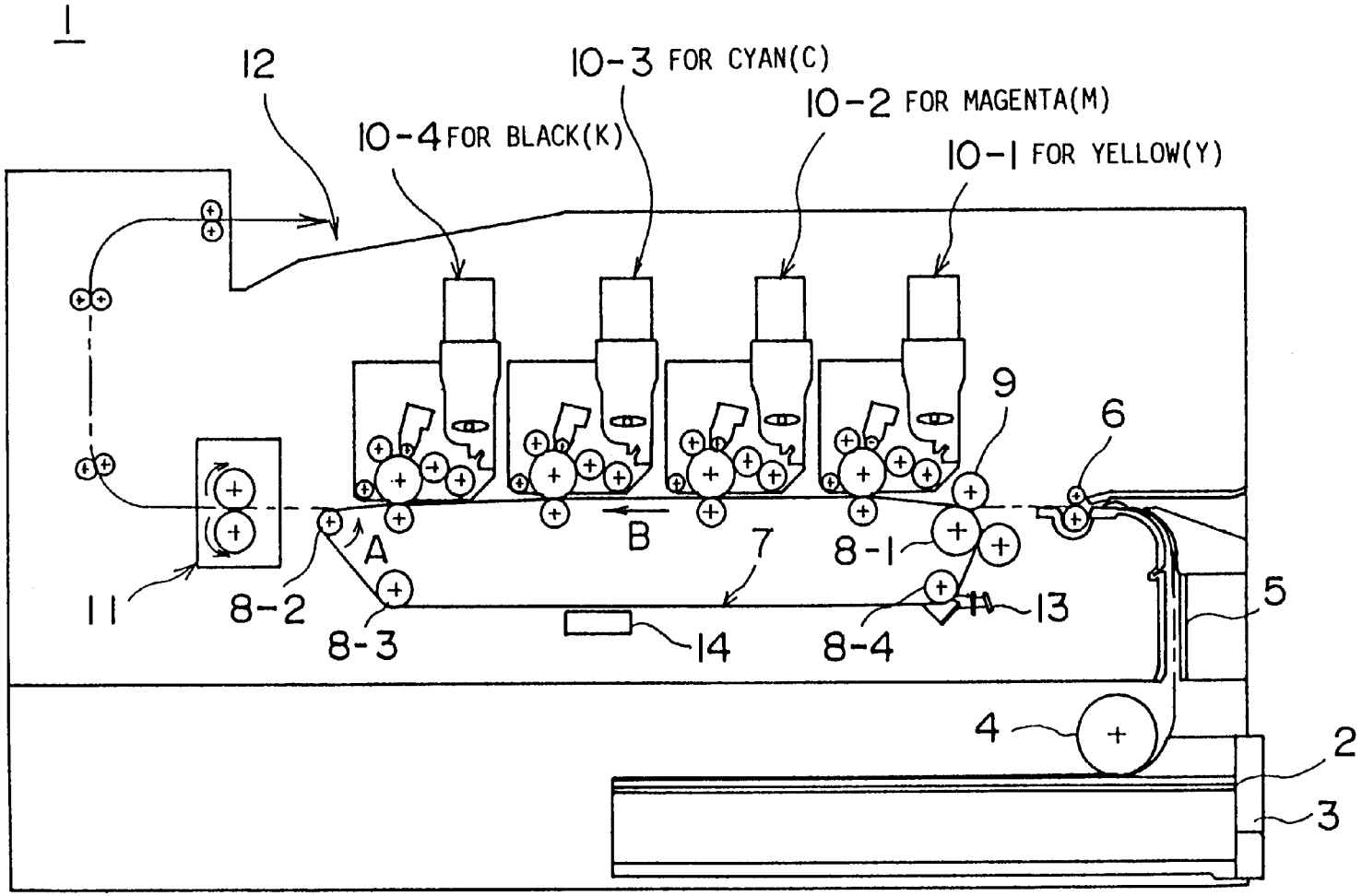
FIG. 3 shows a general arrangement of one embodiment of the present invention.

FIG. 3 shows the general arrangement of the embodiment of the present invention.

In the image forming apparatus in the embodiment, a recording medium, for example, recording paper, is held in a paper tray 3. The recording paper 2 is picked up from the paper tray 3 by a picking-up roller 4 disposed above the paper tray 3, sequentially.

The recording paper 2 picked up by the picking-up roller 4 is supplied to a paper-feeding roller 6 via a guiding portion 5. The paper-feeding roller 6 sends the recording paper 6 supplied via the guiding portion 5 onto an endless belt 7 which forms a predetermined carrying path. The recording paper 2 is carried by the endless belt 7 on the predetermined carrying path.

The endless belt 7 forms an endless course by means of rollers 8-1 through 8-4. The recording paper 2 is carried on the outside of the side of the endless course of the endless belt 7 formed by the rollers 8-1 and 8-2. An electric charging roller 9 is provided opposite to the roller 8-1, and the recording paper 2 and the endless belt 7 are sandwiched between the roller 8 and the electric charging roller 9.

The recording paper 2 and the endless belt 7 are electrically charged by the roller 8-1 and the electric charging roller 9. Thereby, the recording paper 2 is adhered to the endless belt 7 electrostatically. Thereby, the recording paper 2 moves with the endless belt 7 as the endless belt 7 moves.

The roller 8-2 is rotated in the direction of the arrow A by a motor, and moves the endless belt 7 in the direction of the arrow B. Thereby, the recording paper 2 moves in the direction of the arrow B together with the endless belt 7.

On the outside of the side of the endless course of the endless belt 7 formed by the rollers 8-1 and 8-2, electrostatic recording units 10-1 through 10-4 are disposed sequentially. Each of the electrostatic recording units 10-1 through 10-4 contains a toner, and records a toner image corresponding to a recording image on the recording paper 2 electrostatically. The electrostatic recording units 10-1, 10-2, 10-3 and 10-4 contain toners of yellow, magenta, cyan and black, respectively, and transfer toner images of the respective colors to the recording paper 2 when the recording paper 2 passes under the electrostatic recording units 10-1 through 10-4, respectively.

Figure 4:
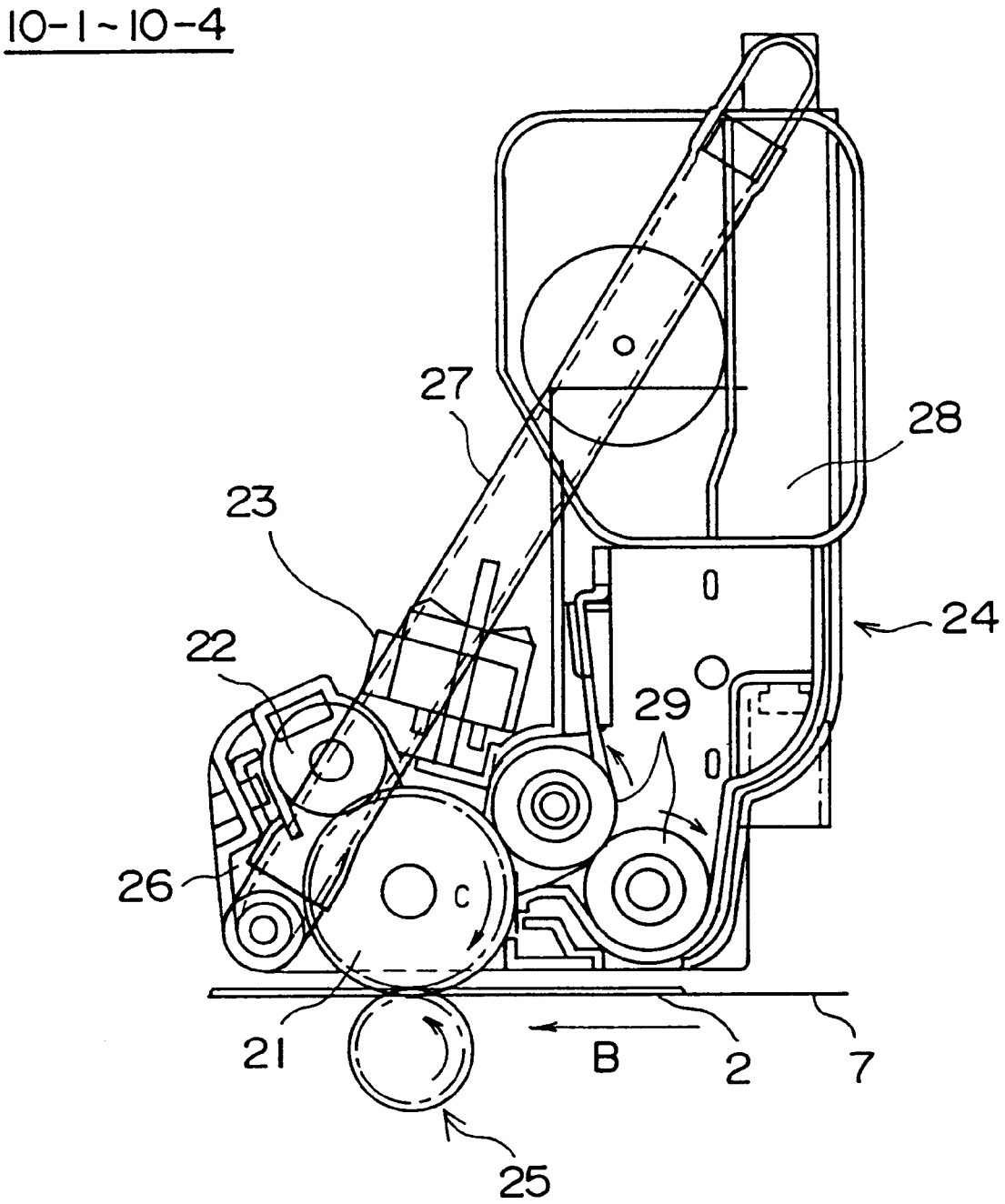
FIG. 4 shows a general arrangement of an electrostatic recording unit in the embodiment of the present invention.

FIG. 4 shows a general arrangement of each of the electrostatic recording units 10-1 through 10-4 in the embodiment of the present invention.

Each electrostatic recording unit includes a photosensitive drum 21 on which a toner image to be transferred to the recording paper 2 is formed, an electric charger 22 for electrically charging the photosensitive drum 21, a laser diode array 23 for forming an electrostatic latent image corresponding to recording data (image data) on the photosensitive drum 21, a developer 24 for supplying the toner to the photosensitive drum 21 so as to form the toner image from the electrostatic latent image using the supplied toner, a transfer roller 25, which is disposed opposite to the photosensitive drum 21 via the recording paper 2 and the endless belt 7, for transferring the toner image to the recording paper 2, a toner cleaner 26 for removing the residual toner from the photosensitive drum 21 after the toner image on the photosensitive drum 21 is transferred to the recording paper 2, and a screw conveyer 27 for returning the residual toner removed from the photosensitive drum 21 to the developer 24.

The developer 24 includes a toner container 28 for containing the toner and a toner supply roller 29 for supplying the toner contained in the toner container 28 to the photosensitive drum 21.

When the toner image is transferred to the recording paper 2, the photosensitive drum 21 is rotated in the direction of the arrow C. The photosensitive drum 21 is uniformly electrically charged by the electric charger 22. The electric charger 22 comprises, for example, a corona electric charger, scorotoron electric charger, or the like.

The photosensitive drum 21 electrically charged uniformly by the electric charger 22 is irradiated by laser light emitted from the laser diode array 23 corresponding to the recording data. When being irradiated by the laser light, the electric charges at the positions at which the photosensitive drum 21 is irradiated are reduced, and, thereby, the electrostatic latent image is formed on the photosensitive drum 21.

When the electrostatic latent image is formed by the laser light on the photosensitive drum 21, the developer 24 electrically charges the toner and supplies the electrically charged toner to the photosensitive drum 21. Thereby, the toner is adhered on the photosensitive drum 21 in accordance with the electric charges of the electrostatic latent image. Thus, the toner image is formed on the photosensitive drum 21.

The photosensitive drum 21 on which the toner image is formed comes into contact with the recording paper 2. The recording paper 2 is electrically charged to the polarity reverse of the polarity of the toner of the toner image. As a result, the toner image formed on the photosensitive drum 21 is transferred to the recording paper 2.

With reference to FIG. 3, when passing under the electrostatic recording units 10-1 through 10-4, the toner images of the colors of the electrostatic recording units 10-1 through 10-4 are transferred to the recording paper 2 so as to be overlaid on each other. Then, finally, the full-color toner image is recorded on the recording paper. After that, the recording paper 2 having the full-color toner image formed thereon is supplied to the roller 8-2.

The electric charges of the recording paper 2 and the endless belt 7 are removed by the roller 8-2. Thereby, the recording paper 2 electrostatically adhered to the endless belt 7 is released from the endless belt 7. Thus, when the endless belt 7 moves downward by the roller 8-2, the recording paper 2 is removed from the endless belt 7, and, then, is supplied to a fixing unit 11.

The fixing unit 11 fixes the full-color toner image of to the recording paper 2 as a result of, for example, heating the recording paper 2 on which the full-color toner image has been formed. The recording paper 2, to which the full-color toner image has been fixed, is supplied to a stacker 12 which holds the recording paper 2 on which the recording image has been recorded.

After the recording paper 2 is removed from the endless belt 7, the electric charges on the endless belt 7 are removed by an electric-charge removing brush 13, and the endless belt 2 is electrically charged again by the electric charging roller 9. The movement of the endless belt 7 is detected by a position sensor 14, and, the moved position of the endless belt 7 is detected by the position sensor 14. Thereby, the position of the recording paper 2 on the endless belt 7 is detected. Thereby, the timing of transfer of the toner images of the electrostatic recording units 10-1 through 10-4 onto the recording paper 2 is controlled, and, thus, the toner images of yellow, magenta, cyan and black are transferred onto the recording paper so as to be overlaid on each other, at appropriate positions. Thus, the full-color toner image is formed on the recording paper 2.

A hardware arrangement of the image forming apparatus 1 in the embodiment of the present invention will now be described.

Figure 5:
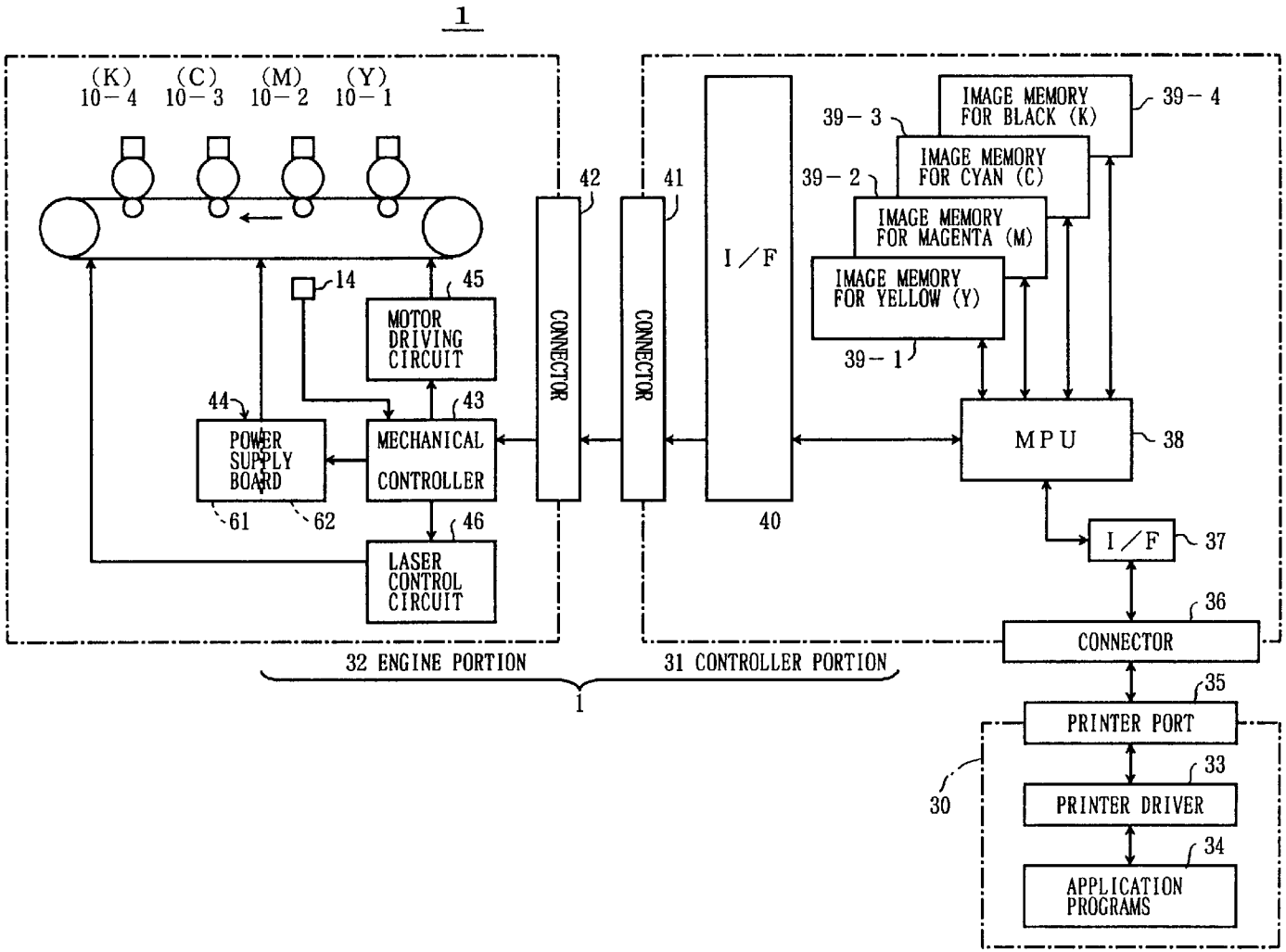
FIG. 5 shows a block diagram of the embodiment of the present invention.

FIG. 5 shows a block diagram of the embodiment of the present invention. In the block diagram, the same reference numerals are given to the parts/components the same as those shown in FIG. 3, and the descriptions therefor will be omitted.

The image forming apparatus 1 in the embodiment includes a controller portion 31, which performs predetermined processing in accordance with data provided from a personal computer 30, and an engine portion 32, which forms an image in accordance with a result of the processing performed by the controller portion 31.

In the personal computer 30, a printer driver 33 for supplying, to the image forming apparatus 1, the recording data and various parameters such as a type and a size of a recording medium, a setting of a recording mode and so forth. The printer driver 33 is linked with various application programs 34, starts in accordance with instructions provided from one of the application programs 34, and supplies the recording data specified by the one of the application programs 34 to the image forming apparatus 1 via a printer port 35.

Operations of the printer driver 33 will now be described with reference FIG. 6.

Figure 6:
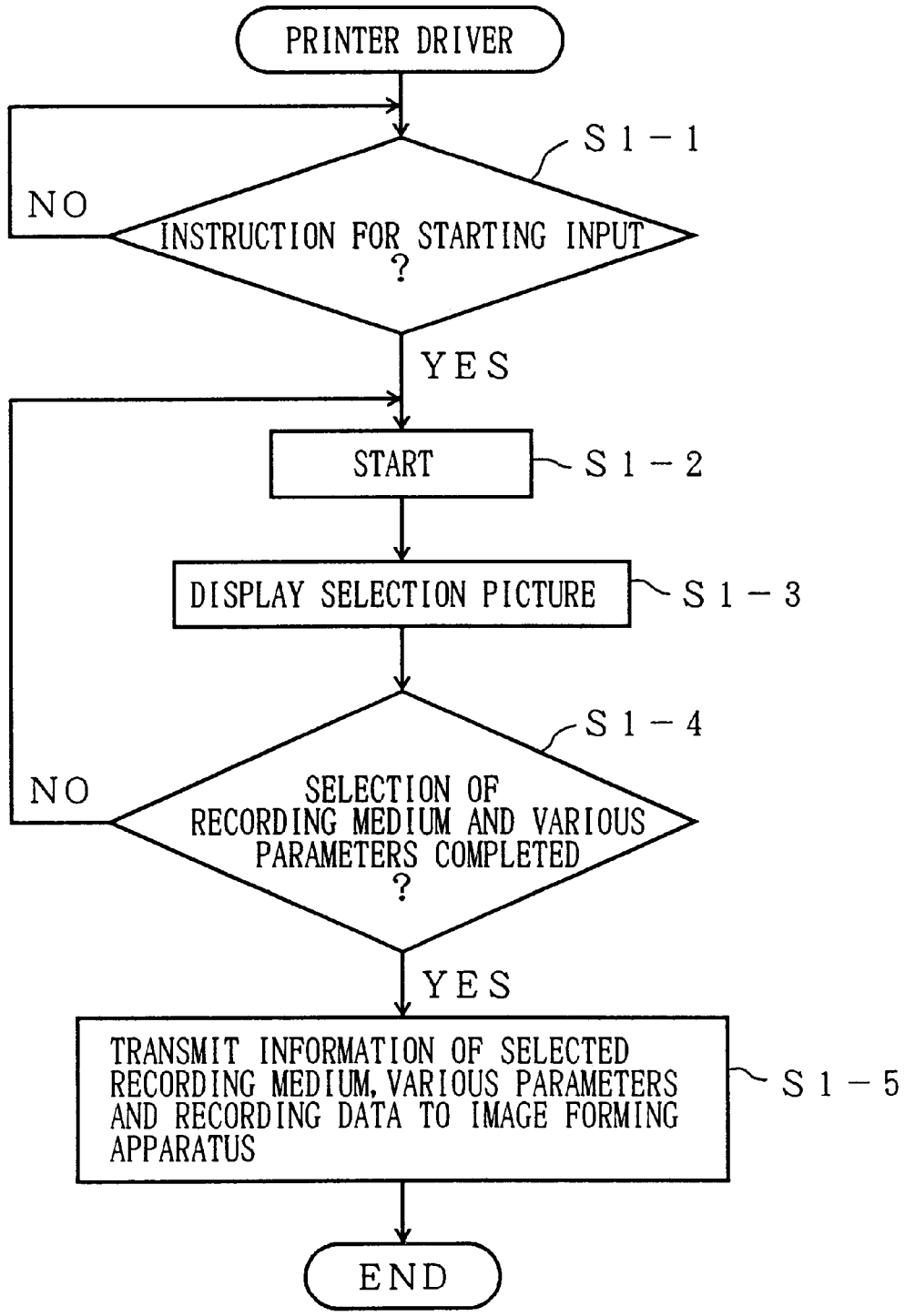
FIG. 6 shows an operation flowchart of a printer driver in the embodiment of the present invention.

FIG. 6 shows an operation flowchart of the printer driver 33 in the embodiment of the present invention.

After receiving instructions for printing from one of the application programs 34, the printer driver 33 is started (in steps S1-1, S1-2).

When the printer driver 33 is started in the step S1-2, a selection picture is displayed on the display of the personal computer 3 (in step S1-3). This selection picture is used for an operator to set the type of the recording medium as to whether the recording medium used in the printing is ordinary paper or a film for an OHP (Over Head Projector), the size of the recording medium, the recording mode as to whether an image to be printed is a monochrome image or a color image, and so forth.

In the step S1-3, an operator selects the type and size of the recording medium and the recording mode through an inputting device such as a keyboard, a mouse and/or the like. Then, as a result of the 'Enter' key of the keyboard being pressed, the personal computer 30 determines that the selection has been completed (in a step S1-4).

When the selection is completed in the step S1-4, the information of the selected type and size of the recording medium, the recording mode, and the recording data to be printed out are output via the printer port 35 (in a step S1-5).

With reference to FIG. 5, the printer port 35 of the personal computer 30 is connected with a connector 36 provided on the control portion 31 of the image forming apparatus 1. The connector 36 is connected with an interface circuit 37 which is connected with an MPU 38 provided in the controller portion 31. The interface circuit 37 acts as an interface between the printer port 35 of the personal computer 30 and the MPU 38 of the controller portion 31. Thereby, data supplied from the personal computer 30 is supplied to the MPU 38.

The MPU 38 develops the recording data supplied from the personal computer 30 in image memories 39-1 through 39-4 for the respective colors, yellow (Y), magenta (M), cyan (C) and black (K). At the same time, the MPU 38 generates control data in accordance with the information of the selected type and size of the recording medium and the various parameters such as setting of the recording mode, and sends the control data to an interface circuit 40.

Figure 7:
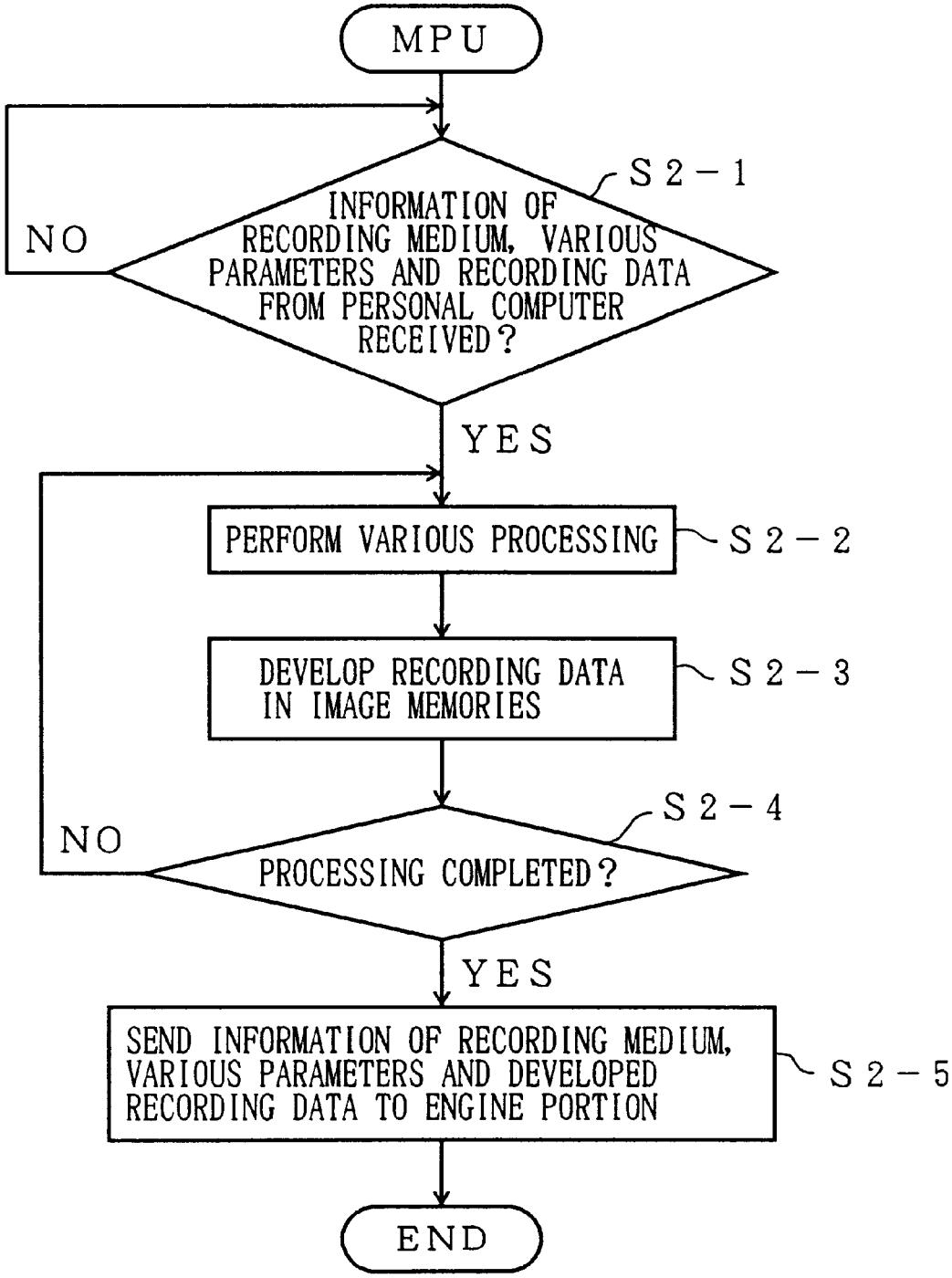
FIG. 7 shows an operation flowchart of an MPU in a control portion in the embodiment of the present invention.

With reference to FIG. 7, operations of the MPU 38 will now be described.

FIG. 7 shows an operation flowchart for the MPU 38 of the controller portion 31 in the embodiment of the present invention.

After receiving the information of the type and size of the recording medium, the various parameters such as the recording mode and so forth, and the recording data from the printer driver 33 of the personal computer 30 (in a step S2-1), the MPU 38 performs processing such as smoothing and so forth on the recording data (in a step S2-2). Then, the MPU 38 develops the recording data in the image memories 39-1 through 39-4 for the respective colors (in a step S2-3)

After completing the processing in the steps S2-2, S2-3 performed on the recording data, the MPU 38 transmits, to the engine portion 32 of the image forming apparatus 1, the information of the type and size of the recording medium, the various parameters such as the recording mode and so forth, and the recording data developed in the image memories 39-1 through 39-4 (in a step S2-5).

With reference to FIG. 5, the interface circuit 40 of the controller portion 31 is connected with a connector 42 of the engine portion 32 via a connector 41. The interface circuit 40 acts as an interface with the engine portion 32. Thereby, the information of the type and size of the recording medium, the various parameters such as the recording mode and so forth and the recording data developed for the respective colors are supplied to the engine portion 32.

The connector 42 of the engine portion 32 is connected with a mechanical controller 43 of the engine portion 32. A power supply board 44 for generating a transfer voltage and an electric charging voltage, a carrying motor (not shown in FIG. 5) for carrying the recording paper 2, a motor driving circuit 45 for driving motors, which rotate the photosensitive drums 21 of the electrostatic recording units 10-1 through 10-4, respectively, and a laser control circuit 46 for controlling the laser diodes of the laser diode arrays 23 which form the electrostatic latent images on the photosensitive drums 21 in the electrostatic recording units 10-1 through 10-4, respectively, are connected to the mechanical controller 43.

The mechanical controller 43 will now be described.

Figure 8:
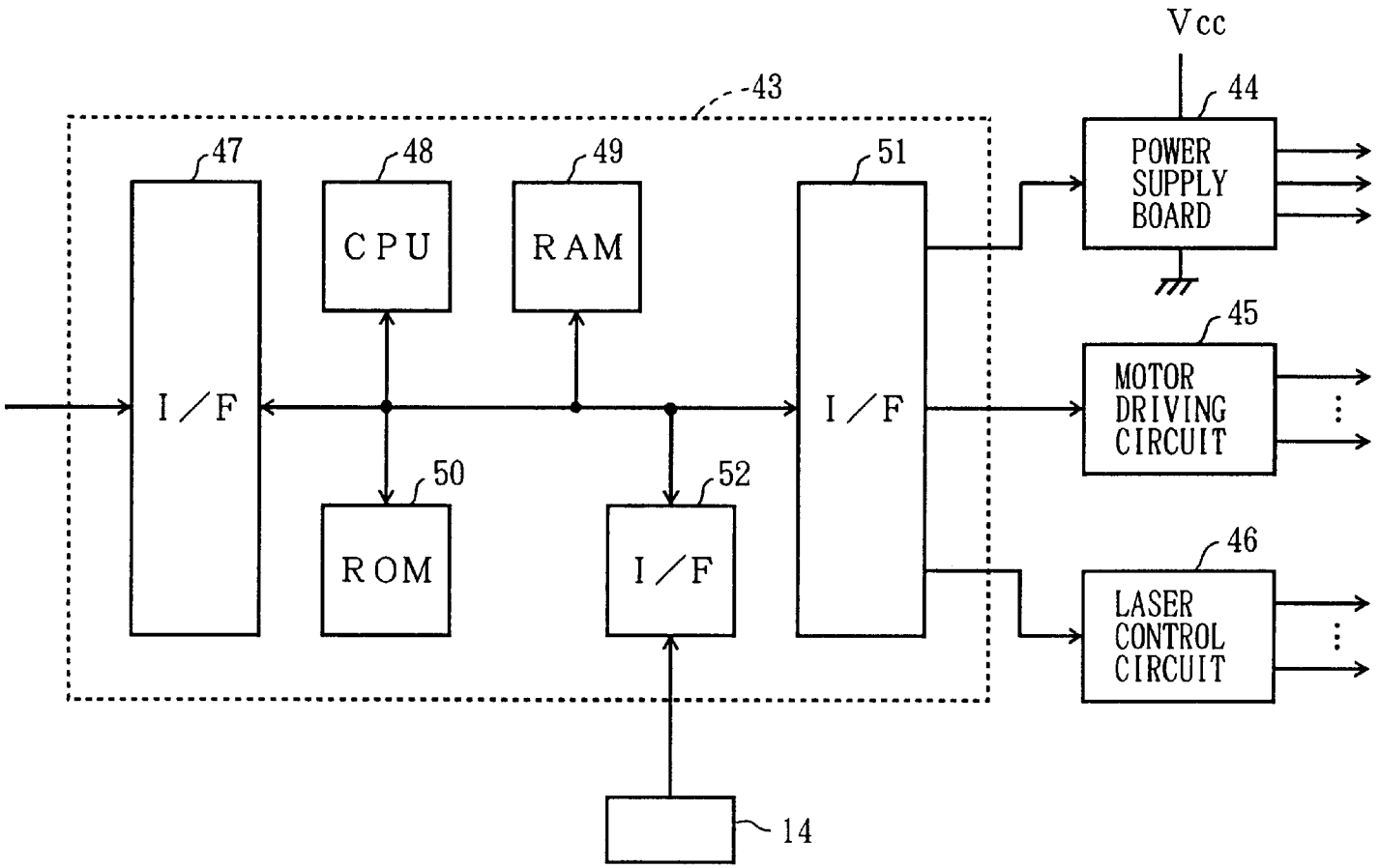
FIG. 8 shows a block diagram of a mechanical controller in the embodiment of the present invention.

FIG. 8 shows a block diagram of the mechanical controller 43 in the embodiment of the present invention.

The mechanical controller 43 includes an interface circuit 47 acting as an interface with the interface circuit 40, a CPU 48 for processing data supplied via the interface circuit 47, a RAM 49 acting as a work area of the CPU 48, a ROM 50 for storing various control programs to be executed by the CPU 48, an interface circuit 51 acting as an interface with the power supply board 44, the motor driving circuit 45 and the laser control circuit 46, an interface circuit 52 for inputting a result of detection performed by the position sensor 14.

The mechanical controller 43 controls the power supply board 44 and the motor driving circuit 45 in accordance with the information of the type and size of the recording medium supplied from the controller portion 31, and controls the laser control circuit 46 in accordance with the recording data supplied from the controller portion 31. Thus, an image in accordance with the recording data supplied from the personal computer 30 is recorded on the recording paper 2.

Figure 9:
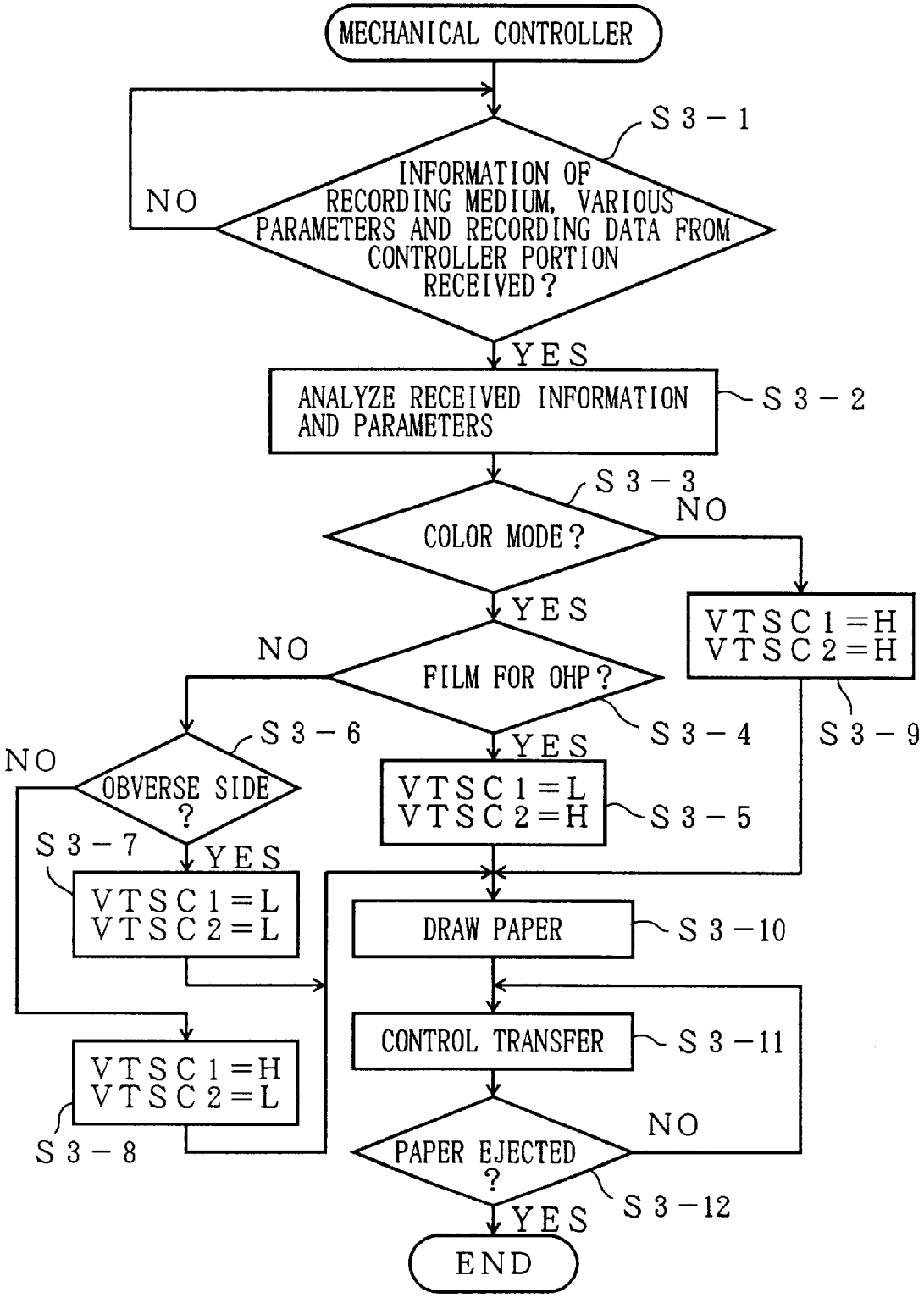
FIG. 9 shows an operation flowchart of the mechanical controller in the embodiment of the present invention.

FIG. 9 shows an operation flowchart of the mechanical controller 43 in the embodiment of the present invention.

When the information of the type and size of the recording medium, the various parameters such as setting of the recording mode and the recording data for each color are supplied from the controller portion 31 (in a step S3-1), the mechanical controller 43 analyzes the thus-supplied information and data (in a step S3-2).

In a case where it is determined, as a result of the analyzing, that the recording mode is the color mode and that the type of the recording medium is a film for an OHP (in steps S3-3, S3-4), a first selection signal VTCS1 to be supplied to the power supply board 44 is caused to be at a low level and a second selection signal VTCS2 to be supplied to the power supply board 44 is caused to be at a high level (in a step S3-5).

In a case where it is determined, as a result of the analyzing, that the recording mode is the color mode and that the type of the recording medium is the obverse side of ordinary paper (in steps S3-3, S3-4, S3-6), the first selection signal VTCS1 is caused to be at the low level and the second selection signal VTCS2 is caused to be at the low level (in a step S3-7).

In a case where it is determined, as a result of the analyzing, that the recording mode is the color mode and that the type of the recording medium is the reverse side of ordinary paper (in the steps S3-3, S3-4, S3-6), the first selection signal VTCS1 is caused to be at the high level and the second selection signal VTCS2 is caused to be at the low level (in a step S-38).

In a case where it is determined, as a result of the analyzing, that the recording mode is the monochrome mode (in the step S3-3), the first selection signal VTCS1 is caused to be at the high level and the second selection signal VTCS2 is caused to be at the high level (in a step S3-9).

FIG. 10 illustrates the selection signals in accordance with the type of the recording medium and the recording mode.

As a result of the steps S3-3 through S3-9 being executed, the first and second selection signals VTCS1, VTCS2 having the levels shown in FIG. 10 are generated and supplied to the power supply board 44.

The power supply board 44 is controlled by the thus-generated first and second selection signals VTCS1, VTCS2. As a result, the voltages to be applied to the transfer rollers 25 of the electrostatic recording units 10-1 through 10-4 are set, respectively, and the voltage to be applied to the electric charging roller S and the voltage to be applied to the electric-charge removing brush 13 are set. After that, the mechanical controller 43 controls the motor driving circuit 45. Thereby, the motor driving circuit 45 drives a belt motor for driving the endless belt 7, photosensitive-drum motors for driving the photosensitive drums 21, respectively, and so forth, and the recording paper 2 is drawn out from the paper tray 3 (in a step S3-10).

When the endless belt 7 is driven as mentioned above, the position of the endless belt 7 is detected by the position sensor 14, and the recording paper 2 is drawn out from the paper tray 3, the timing of which is controlled in accordance with a result of the detection performed by the position sensor 14.

When the recording paper 2 reaches the position of the electrostatic recording unit 10-1, the mechanical controller 43 causes a timing control signal *VTYON, to be supplied to the power supply board 44, to be at a low level, and, thereby, causes the power supply board 44 to apply a voltage to the transfer roller 25 of the electrostatic recording unit 10-1. Further, the mechanical controller 43 controls the laser control circuit 46 in accordance with the recording data to be supplied to the electrostatic recording unit 10-1, that is, the recording data of yellow. Thereby, the mechanical controller 43 causes the laser diode array 23 of the electrostatic recording unit 10-1 to emit light in accordance with the recording data of yellow so as to cause the toner image of yellow to be formed on the photosensitive drum 21, the thus-formed toner image of yellow being then transferred onto the recording paper 2. Then, when the recording paper 2 reaches the position of the electrostatic recording unit 10-2, the mechanical controller 43 causes a timing control signal *VTMON, to be supplied to the power supply board 44, to be at the low level, and, thereby, causes the power supply board 44 to apply a voltage to the transfer roller 25 of the electrostatic recording unit 10-2. Further, the mechanical controller 43 controls the laser control circuit 46 in accordance with the recording data to be supplied to the electrostatic recording unit 10-2, that is, the recording data of magenta. Thereby, the mechanical controller 43 causes the laser diode array 23 of the electrostatic recording unit 10-2 to emit light in accordance with the recording data of magenta so as to cause the toner image of magenta to be formed on the photosensitive drum 21, the thus-formed toner image of magenta being then transferred onto the recording paper 2. Then, when the recording paper 2 reaches the position of the electrostatic recording unit 10-3, the mechanical controller 43 causes a timing control signal *VTCON, to be supplied to the power supply board 44, to be at the low level, and, thereby, causes the power supply board 44 to apply a voltage to the transfer roller 25 of the electrostatic recording unit 10-3. Further, the mechanical controller 43 controls the laser control circuit 46 in accordance with the recording data to be supplied to the electrostatic recording unit 10-3, that is, the recording data of cyan. Thereby, the mechanical controller 43 causes the laser diode array 23 of the electrostatic recording unit 10-3 to emit light in accordance with the recording data of cyan so as to cause the toner image of cyan to be formed on the photosensitive drum 21, the thus-formed toner image of cyan being then transferred onto the recording paper 2. Then, when the recording paper 2 reaches the position of the electrostatic recording unit 10-4, the mechanical controller 43 causes a timing control signal *VTKON, to be supplied to the power supply board 44, to be at the low level, and, thereby, causes the power supply board 44 to apply a voltage to the transfer roller 25 of the electrostatic recording unit 10-4. Further, the mechanical controller 43 controls the laser control circuit 46 in accordance with the recording data to be supplied to the electrostatic recording unit 10-4, that is, the recording data of black. Thereby, the mechanical controller 43 causes the laser diode array 23 of the electrostatic recording unit 10-4 to emit light in accordance with the recording data of black so as to cause the toner image of black to be formed on the photosensitive drum 21, the thus-formed toner image of black being then transferred onto the recording paper 2.

Thus, the laser control circuit 46 is controlled in accordance with the recording data, the laser diode arrays 23 of the electrostatic recording units 10-1 through 10-4 are caused to emit light, and the toner images are transferred onto the recording paper 2, respectively (in a step S3-11).

The processing of the mechanical controller 43 is finished when the recording paper 2 on which the toner images have been transferred is supplied to the fixing unit 11, the toner images are fixed to the recording paper 2, and the recording paper 2 is ejected to the stacker 12 (in a step S3-12).

The power supply board 44 will now be described.

Figure 11:
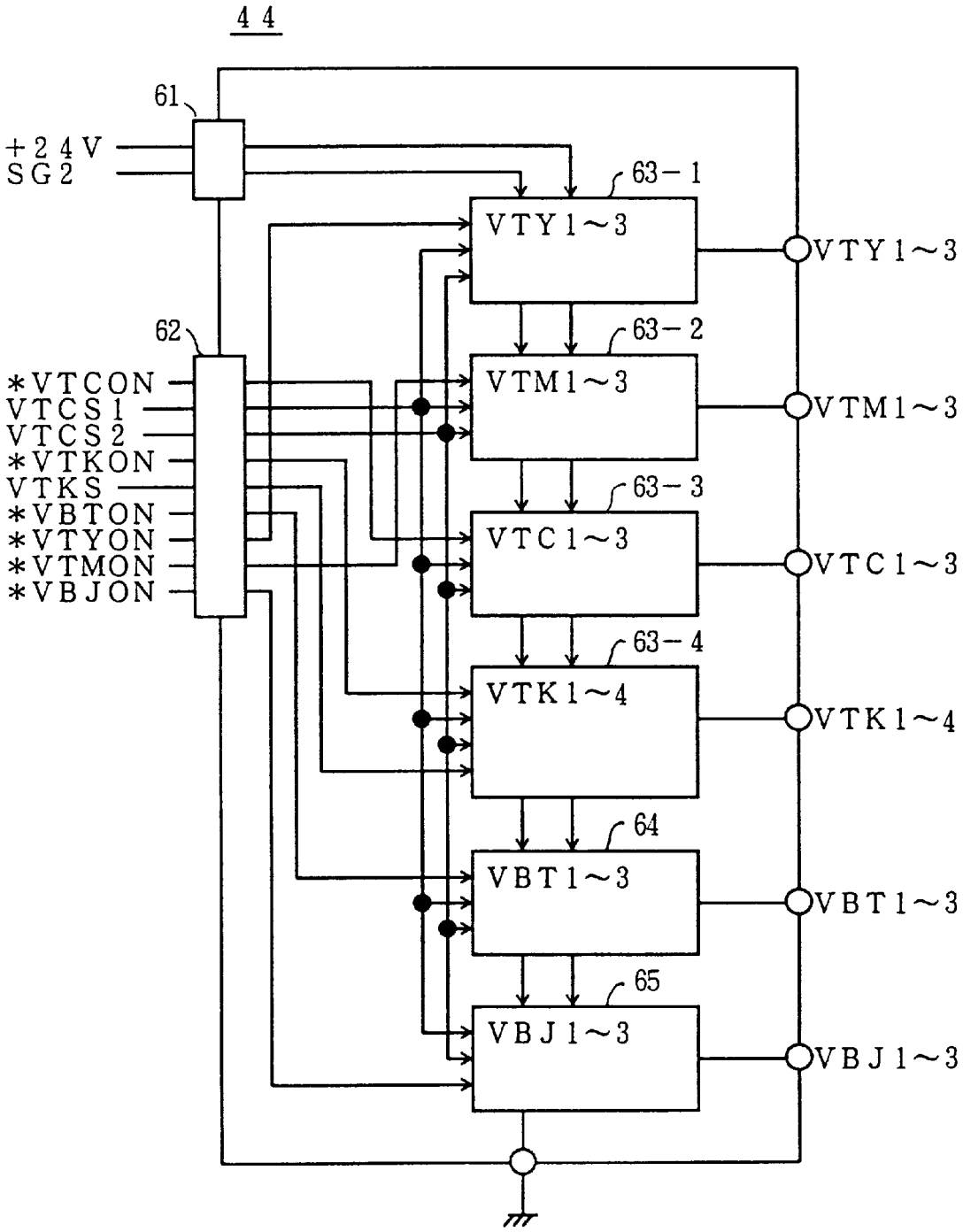
FIG. 11 shows a block diagram of a power supply board in the embodiment of the present invention.

FIG. 11 shows a block diagram of the power supply board 44 in the embodiment of the present invention.

The power supply board 44 includes a power source connector 61 for inputting a power source voltage, and a control connector 62 for inputting various signals, which are output from the mechanical controller 43 in accordance with the selected recording medium and the selected recording mode. The power supply board 44 further includes a first transfer voltage generating circuit 63-1 which generates the voltage, in accordance with the control signals to be supplied thereto via the control connector 62, to be applied to the transfer roller 25 of the electrostatic recording unit 10-1, a second transfer voltage generating circuit 63-2 which generates the voltage, in accordance with the control signals to be supplied thereto via the control connector 62, to be applied to the transfer roller 25 of the electrostatic recording unit 10-2, a third transfer voltage generating circuit 63-3 which generates the voltage, in accordance with the control signals to be supplied thereto via the control connector 62, to be applied to the transfer roller 25 of the electrostatic recording unit 10-3, and a fourth transfer voltage generating 63-4 which generates the voltage, in accordance with the control signals to be supplied thereto via the control connector 62, to be applied to the transfer roller 25 of the electrostatic recording unit 10-4. The power supply board 44 further includes a belt voltage generating circuit 64 for generating the voltage, in accordance with the control signals input thereto via the control connector 62, to be applied to the endless belt 7, and an electric-charge-removing-brush voltage generating circuit 65 for generating the voltage, in accordance with the control signals input thereto via the control connector 62, to be applied to the electric-charge removing brush 13.

The first and second selection signals VTCS1, VTCS2, which are supplied by the mechanical controller 43 in accordance with the selected recording medium and the selected recording mode, are supplied to the control connector 62. Further, timing signals *VTYON, *VTMON, *VTCON, *VTKON, *VBTON and *VBJON for controlling operation timings of the first through fourth transfer voltage generating circuits 63-1 through 63-4, the belt voltage generating circuit 64 and the electric-charge-removing-brush voltage generating circuit 65, respectively.

The first and second selection signals VTCS1, VTCS2, and the timing control signal *VTYON are supplied to the first transfer voltage generating circuit 63-1 via the control connector 62. The first and second selection signals VTCS1, VTCS2, and the timing control signal *VTMON are supplied to the second transfer voltage generating circuit 63-2 via the control connector 62. The first and second selection signals VTCS1, VTCS2, and the timing control signal *VTCON are supplied to the third transfer voltage generating circuit 63-3 via the control connector 62. The first and second selection signals VTCS1, VTCS2, and the timing control signal *VTKON are supplied to the fourth transfer voltage generating circuit 63-4 via the control connector 62.

The first and second selection signals VTCS1, VTCS2, and the timing control signal *VBTON are supplied to the belt voltage generating circuit 64 via the control connector 62. The first and second selection signals VTCS1, VTCS2, and the timing control signal *VBJON are supplied to the electric-charge-removing-brush voltage generating circuit 65 via the control connector 62.

The first transfer voltage generating circuit 63-1 generates first through third transfer voltages VTY1 through VTY3 in accordance with the first and second selection signals VTCS1, VTCS2. The second transfer voltage generating circuit 63-2 generates first through third transfer voltages VTM1 through VTM3 in accordance with the first and second selection signals VTCS1, VTCS2. The third transfer voltage generating circuit 63-3 generates first through third transfer voltages VTC1 through VTC3 in accordance with the first and second selection signals VTCS1, VTCS2. The fourth transfer voltage generating circuit 63-4 generates first through fourth transfer voltages VTK1 through VTK4 in accordance with the first and second selection signals VTCS1, VTCS2. The belt voltage generating circuit 64 generates first through third electric charging voltages VBT1 through VBT3 in accordance with the first and second selection signals VTCS1, VTCS2. The electric-charge-removing-brush voltage generating circuit 65 generates first through third electric-charge removing voltages VBJ1 through VBJ3 in accordance with the first and second selection signals VTCS1, VTCS2.

FIG. 12 shows relationships between the output mode, the levels of the selection signals, and the output voltages in the embodiment of the present invention.

In the case where the first selection voltage VTCS1 is at the low level and the second selection voltage VTCS2 is at the low level, that is, in the case where color printing is performed on the obverse side of ordinary paper, the first through fourth transfer voltage generating circuits 63-1 through 63-4 generate the transfer voltages VTY1, VTM1, VTC1, VTK1, respectively, the belt voltage generating circuit 64 generates the electric charging voltage VBT1, and the electric-charge-removing-brush voltage generating circuit 65 generates the electric-charge removing voltage VBJ1. The thus-generated voltages are applied to the respective portions. In the case where the first selection voltage VTCS1 is at the low level and the second selection voltage VTCS2 is at the high level, that is, in the case where printing is performed on a film for an OHP, the first through fourth transfer voltage generating circuits 63-1 through 63-4 generate the transfer voltages VTY2, VTM2, VTC2, VTK2, respectively, the belt voltage generating circuit 64 generates the electric charging voltage VBT2, and the electric-charge-removing-brush voltage generating circuit 65 generates the electric-charge removing voltage VBJ2. The thus-generated voltages are applied to the respective portions. In the case where the first selection voltage VTCS1 is at the high level and the second selection voltage VTCS2 is at the low level, that is, in the case where color printing is performed on the reverse side of ordinary paper, the first through fourth transfer voltage generating circuits 63-1 through 63-4 generate the transfer voltages VTY3, VTM3, VTC3, VTK3, respectively, the belt voltage generating circuit 64 generates the electric charging voltage VBT1, and the electric-charge-removing-brush voltage generating circuit 65 generates the electric-charge removing voltage VBJ1. The thus-generated voltages are applied to the respective portions. In the case where the first selection voltage VTCS1 is at the high level and the second selection voltage VTCS2 is at the high level, that is, in the case where monochrome printing is performed, the fourth transfer voltage generating circuit 63-4 generates the transfer voltages VTK4, the belt voltage generating circuit 64 generates the electric charging voltage VBT3, and the electric-charge-removing-brush voltage generating circuit 65 generates the electric-charge removing voltage VBJ3. The thus-generated voltages are applied to the respective portions.

At this time, the transfer voltages VTY1 through VTY3, VTM1 through VTM3, VTC1 through VTC3, and VTK1 through VTK4 generated by the first through fourth transfer voltage generating circuits 63-1 through 63-4, respectively, increase in the order of the first through fourth transfer voltage generating circuits 63-1 through 63-4 in a manner to be described later.

Thereby, when the electric potential of the recording paper 2 decreases as the recording paper 2 passes under the electrostatic recording units 10-1 through 10-4, this decrease of the electric potential of the recording paper 2 is compensated by the above-mentioned increase of the electric potentials of the transfer rollers 25 of the electrostatic recording units 10-1 through 10-4. As a result, it is possible to balance the printing tones between the respective electrostatic recording units 10-1 through 10-4.

Further, at this time, if the electric potential of the transfer roller 25 of the electrostatic recording unit 10-1 under which the recording paper 2 passes first is set to be large, the electric potential of the transfer roller 25 of the electrostatic recording unit 10-4 under which the recording paper 2 passes last is extremely large. Thereby, leakage of electric currents and/or generation of ozone may occur.

In order to prevent such problems, at least the electric potential of the transfer roller 25 of the electrostatic recording unit 10-1 under which the recording paper 2 first passes is set to have a minus polarity, similar to the minus polarity of the electric potential of electrically charged toner.

As a result of setting the transfer voltages VTY1 through VTY3 generated by the first transfer voltage generating circuit 63-1 to have the minus polarity the same as the minus polarity of the electric potential of the electrically charged toner, the electric potential of the transfer roller 25 of the electrostatic recording unit 10-4 under which the recording paper 2 passes last is not very large. Leakage of electric currents and/or generation of ozone can be prevented from occurring.

The electric potentials of the transfer rollers 25 and the electric potential of the electrically charged endless belt 7 at this time are determined as follows:

First, a method for setting the transfer voltage to be applied to the transfer roller 25 of the electrostatic recording unit 10-1 under which the recording paper 1 passes first will now be described.

For example, it is assumed that the volume resistivity of the endless belt 7 is $10^{13}$ through $10^{15}$ Ω, the surface resistivity of the endless belt 7 (obverse side) is $10^{15}$ through $10^{17}$ Ω, the surface resistivity of the endless belt 7 (reverse side) is $10^{15}$ through $10^{17}$ Ω, the electrostatic capacity of the endless belt 7 is 0.62 through 0.75 $\mu F/m^2$, the volume resistivity of the transfer roller 25 is $9\times10^3$ Ω, $3\times10^4$ Ω and $1\times10^5$ Ω, the volume resistivity of the electric charging roller 9 is $2\times10^6$ through $9\times10^6$ Ω, and the volume resistivity of the electric-charge removing brush 13 is $1\times10^4$ through $7\times10^6$ Ω. Further, the toner is electrically charged to have a minus polarity. Further, as the recording medium, ordinary paper having the volume resistivity of $10^7$ through $10^9$ Ω, the surface resistivity of $10^9$ through $10^{11}$ Ω, the relative permittivity of 2 through 3.5, and a film for an OHP having the volume resistivity of $10^{15}$ through $10^{16}$ Ω, the surface resistivity of $10^9$ through $10^{16}$ Ω, and the relative permittivity of 2 through 3.5. The transfer efficiencies with respect to the electric potentials of the transfer roller 25 and the endless belt 7, assuming the above-described conditions, will now be described.

Figure 13A:
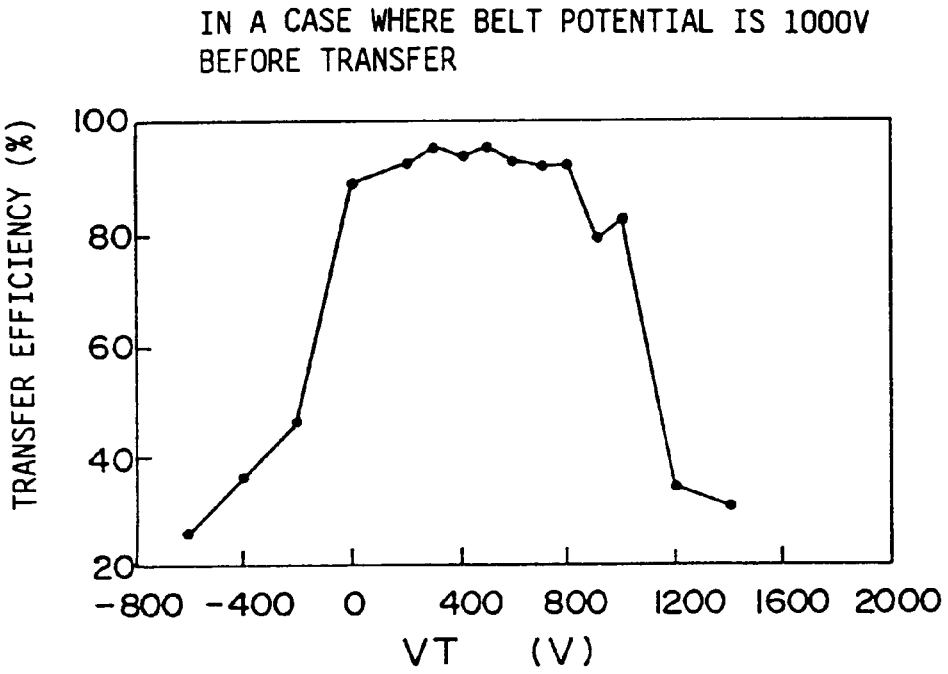
FIGS. 13A and 13B show the characteristics of transfer efficiencies when printing is performed on ordinary paper with respect to transfer electric potentials and belt electric potentials.
Figure 13B:
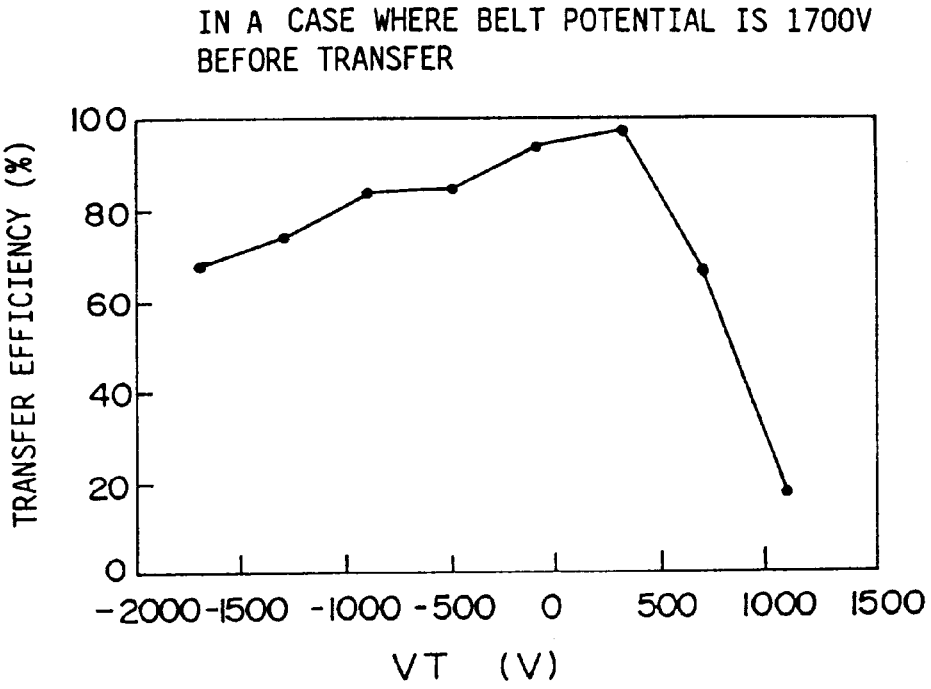

FIGS. 13A and 13B show the toner transfer efficiencies when printing is performed on the ordinary paper with respect to the toner transfer electric potentials and the belt electric potentials. FIG. 13A shows the toner transfer efficiencies in a case where the belt electric potential of the endless belt 7 before the toner transfer is 1000 V and the toner transfer electric potential of the transfer roller 25 (VT) varies from −600 through +1400 V. FIG. 13B shows the toner transfer efficiencies in a case where the belt electric potential of the endless belt 7 before the transfer is 1700 V and the toner transfer electric potential of the transfer roller 25 varies from −1700 through +1100 V.

In the case shown in FIG. 13B where the electric potential of the endless belt 7 is set to 1700 V, the toner transfer efficiency is maintained higher than 80% as the electric potential of the transfer roller 25 is decreased to around −1000 V. However, in the case shown in FIG. 13A where the electric potential of the endless belt 7 is set to 1000 V, the toner transfer efficiency is decreased to lower than 80% as the electric potential of the transfer roller 25 is decreased to have a minus value, and thereby, printing tone decreases. Therefore, in the case where the electric potential of the transfer roller 25 is set to have a minus value, it is necessary to set the electric potential of the endless belt 7 to be equal to or higher than 1000 V for the ordinary paper.

Figure 14A:
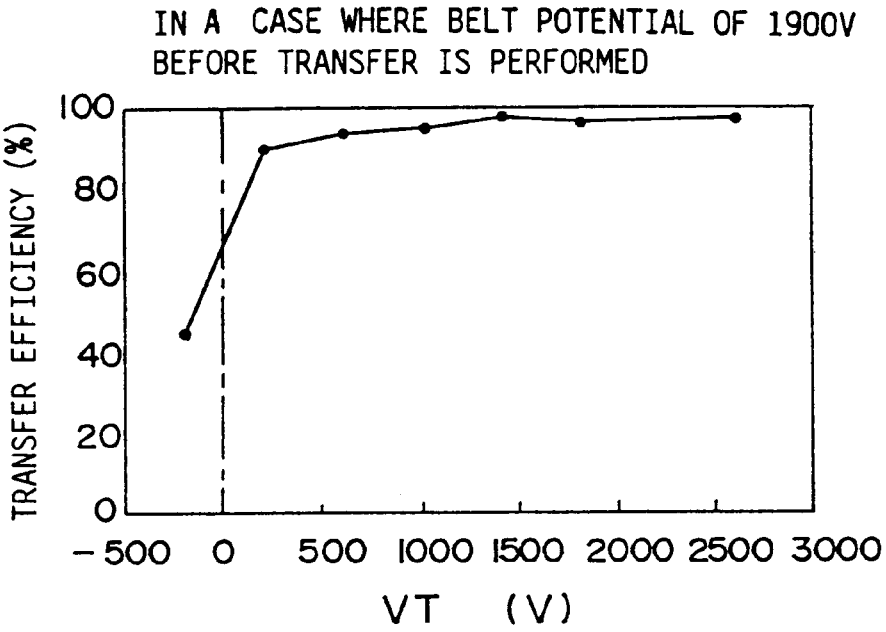
FIGS. 14A and 14B show the characteristics of transfer efficiencies when printing is performed on a film for an OEP with respect to transfer electric potentials and belt electric potentials.
Figure 14B:
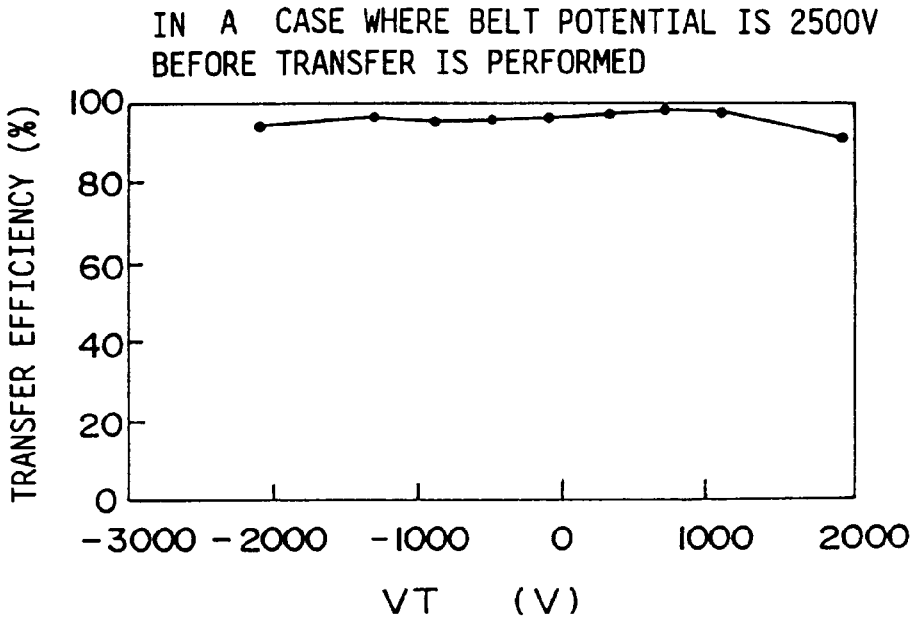

FIGS. 14A and 14B show the toner transfer efficiencies when printing is performed on the film for an OHP with respect to the transfer electric potentials and the belt electric potentials. FIG. 14A shows the toner transfer efficiencies in a case where the belt electric potential of the endless belt 7 before the toner transfer is 1900 V and the transfer electric potential of the transfer roller 25 varies from −200 through +2600 V. FIG. 14B shows the toner transfer efficiencies in a case where the belt electric potential of the endless belt 7 before the toner transfer is 2500 V and the transfer electric potential of the transfer roller 25 varies from −2100 through +2000 V.

In the case shown in FIG. 14B where the electric potential of the endless belt 7 is set to 2500 V, the toner transfer efficiency is maintained higher than 80% as the electric potential of the transfer roller 25 is decreased to around −2000 V. However, in the case shown in FIG. 14A where the electric potential of the endless belt 7 is set to 1900 V, the toner transfer efficiency is decreased to lower than 80% as the electric potential of the transfer roller 25 is decreased to have a minus value, and thereby, printing tone decreases. Therefore, in the case where the electric potential of the transfer roller 25 is set to have a minus value, it is necessary to set the electric potential of the endless belt 7 to be at least equal to or higher than 1900 V for the film for an OHP.

The electric potential of the endless belt 7 before the toner transfer is determined by the electric charging voltage applied by the electric charging roller 9 and the electric potential of the endless belt 7 after the electric-charge removal is performed on the endless belt 7 by the electric-charge removing brush 13.

Each of FIGS. 15 and 16 shows the characteristics of the electric potential of the endless belt 7 before the toner transfer is performed with respect to the electric potential of the endless belt 7 after the electric-charge removal is performed on the endless belt 7 by the electric-charge removing brush 13 and the electric charging voltage applied by the electric charging roller 9.

As shown in FIGS. 15 and 16, it is possible to set the electric potential of the endless belt 7 before the toner transfer to be higher, as the electric potential of the endless belt 7 after the electric-charge removal performed thereon by the electric-charge removing brush 13 is increased, and, also, as the electric charging voltage applied to the endless belt 7 by the electric charging roller 9 is increased.

Further, when electric charges of the endless belt 7 are removed by the electric-charge removing brush 13, an AC voltage is added to a DC offset voltage. At this time, the stability of the electric potential of the endless belt 7 is determined in accordance with the peak-to-peak voltage of the AC voltage (ACp-p).

FIG. 17 shows the characteristics of the electric potential of the endless belt 7 after the electric-charge removal is performed by the electric-charge removing brush 13 with respect to the ACp-p. In FIG. 17, ○ shows the characteristics in the case where the DC offset voltage is 1500 V. ♦ shows the characteristics in the case where the DC offset voltage is 2500 V.

As shown in FIG. 17, in the case where the ACp-p is approximately 0.75 V, the electric potential of the endless belt 7 after the electric-charge removal is performed by the electric-charge removing brush 13 is close to the set DC offset voltage and is stable, in each of the cases where the DC offset voltage is 1500 V and 2500 V.

Accordingly, the ACp-p of the electric potential supplied to the electric-charge removing brush 13 is set to be 0.75 V.

FIG. 18 shows the characteristics of the DC voltage used in the electric-charge removal, with respect to the electric potential of the endless belt 7 after the electric-charge removal is performed by the electric-charge removing brush 13.

FIG. 18 shows the characteristics in the case where the ACp-p of the electric potential to be supplied to the electric-charge removing brush 13 is set to 0.75 V at which the electric potential of the endless belt 7 after the electric-charge removal is performed by the electric-charge removing brush 13 is stable.

Using the characteristics shown in FIG. 18, it is possible to obtain the electric potential of the endless brush 7 after the electric-charge removal is performed by the electric-charge removing brush 13 to be set.

Using the characteristics shown in FIGS. 15 through 18, it is possible to obtain the electric potentials to be applied to the electric-charge removing brush 13 and the electric charging roller 9.

For example, a case where 1000 V as the electric potential of the endless belt 7 is obtained will now be described. (As described above, the electric potential of the endless belt 7 should be equal to or higher than 1000 V in the case where the electric potential of the transfer roller 25 of the electrostatic recording unit 10-1 can have a minus polarity when the printing is performed on ordinary paper.)

With reference to FIG. 16, in order to obtain 1000 V as the electric potential of the endless belt 7 before the toner transfer is performed, for example, it can be seen that it is necessary to cause the electric potential of the endless belt 7 after the electric-charge removal is performed thereon to be equal to or higher than 1450 V and cause the electric charging voltage of the electric charging roller 9 to be equal to or higher than 0 V; to cause the electric potential of the endless belt 7 after the electric-charge removal is performed thereon to be equal to or higher than 900 V and cause the electric charging voltage of the electric charging roller 9 to be equal to or higher than 1000 V; or cause the electric potential of the endless belt 7 after the electric-charge removal is performed thereon to be equal to or higher than 400 V and cause the electric charging voltage of the electric charging roller 9 to be equal to or higher than 1500 V.

Further, for example, in order to cause the electric potential of the endless belt 7 after the electric-charge removal is performed thereon to be equal to or higher than 1450 V, inferring from the characteristics shown in FIG. 18, it is necessary to cause the DC offset voltage of the electric-charge removing brush 13 to be equal to or higher than 1650 V. In order to cause the electric potential of the endless belt 7 after the electric-charge removal is performed thereon to be equal to or higher than 900 V, inferring from the characteristics shown in FIG. 18, it is necessary to cause the DC offset voltage of the electric-charge removing brush 13 to be equal to or higher than 1020 V. In order to cause the electric potential of the endless belt 7 after the electric-charge removal is performed thereon to be equal to or higher than 400, inferring from the characteristics shown in FIG. 18, it is necessary to cause the DC offset voltage of the electric-charge removing brush 13 to be equal to or higher than 440 V.

Thus, in order to cause the electric potential of the endless belt 7 before the toner transfer to be 1000 V, which is the minimum value in the case where the electric potential of the transfer roller 25 of the electrostatic recording unit 10-1 can have a minus polarity when the printing is performed on ordinary paper, in the case where the ACp-p of the electric-charge removing brush 13 is 0.75 V and the DC offset voltage of the brush 13 is equal to or higher than 1650 V, the electric potential of the electric charging voltage of the electric charging roller 9 is to be equal to or higher than 0 V.

That is, the belt voltage generating circuit 64 is to generate the voltage equal to or higher than 0 V as the first electric charging voltage VBT1, and the electric-charge-removing-brush voltage generating circuit 65 is to generate the voltage having the ACp-p of 0.75 V and the DC offset voltage equal to or higher than 1650 V as the first electric-charge removing voltage VBJ1.

In order to cause the electric potential of the endless belt 7 to be 1000 V, which is the minimum value in the case where the electric potential of the transfer roller 25 of the electrostatic recording unit 10-1 can have a minus polarity when the printing is performed on ordinary paper, in the case where the ACp-p of the electric-charge removing brush 13 is 0.75 V and the DC offset voltage of the brush 13 is equal to or higher than 1020 V, the electric potential of the electric charging voltage of the electric charging roller 9 is to be equal to or higher than 1000 V.

That is, the belt voltage generating circuit 64 is to generate the voltage equal to or higher than 1000 V as the first electric charging voltage VBT1, and the electric-charge-removing-brush voltage generating circuit 65 is to generate the voltage having the ACp-p of 0.75 V and the DC offset voltage equal to or higher than 1020 V as the first electric-charge removing voltage VBJ1.

In order to cause the electric potential of the endless belt 7 to be 1000 V, which is the minimum value in the case where the electric potential of the transfer roller 25 of the electrostatic recording unit 10-1 can have a minus polarity when the printing is performed on ordinary paper, in the case where the ACp-p of the electric-charge removing brush 13 is 0.75 V and the DC offset voltage of the brush 13 is equal to or higher than 440 V, the electric potential of the electric charging voltage of the electric charging roller 9 is to be equal to or higher than 1500 V.

That is, the belt voltage generating circuit 64 is to generate the voltage equal to or higher than 1500 V as the first electric charging voltage VBT1, and the electric-charge-removing-brush voltage generating circuit 65 is to generate the voltage having the ACp-p of 0.75 V and the DC offset voltage equal to or higher than 440 V as the first electric-charge removing voltage VBJ1.

A case where 1900 V of the electric potential of the endless belt 7 is obtained will now be described. (As described above, it is necessary that the electric potential of the endless belt 7 is equal to or higher than 1900 V in the case where the electric potential of the transfer roller 25 of the electrostatic recording unit 10-1 can have a minus polarity when the printing is performed on a film for an OHP.)

With reference to FIG. 16, in order to obtain 1900 V of the electric potential of the endless belt 7 before the toner transfer is performed, for example, it can be seen that it is necessary to cause the electric potential of the endless belt 7 after the electric-charge removal is performed thereon to be equal to or higher than 2500 V and cause the electric charging voltage of the electric charging roller 9 to be equal to or higher than 500 V; to cause the electric potential of the endless belt 7 after the electric-charge removal is performed thereon to be equal to or higher than 2100 V and cause the electric charging voltage of the electric charging roller 9 to be equal to or higher than 1000 V; to cause the electric potential of the endless belt 7 after the electric-charge removal is performed thereon to be equal to or higher than 1380 V and cause the electric charging voltage of the electric charging roller 9 to be equal to or higher than 2000 V; or cause the electric potential of the endless belt 7 after the electric-charge removal is performed thereon to be equal to or higher than 400 V and cause the electric charging voltage of the electric charging roller 9 to be equal to or higher than 3000 V.

Further, for example, in order to cause the electric potential of the endless belt 7 after the electric-charge removal is performed thereon to be equal to or higher than 2500 V, inferring from the characteristics shown in FIG. 18, it is necessary to cause the DC offset voltage of the electric-charge removing brush 13 to be equal to or higher than 2860 V. In order to cause the electric potential of the endless belt 7 after the electric-charge removal is performed thereon to be equal to or higher than 2100 V, inferring from the characteristics shown in FIG. 18, it is necessary to cause the DC offset voltage of the electric-charge removing brush 13 to be equal to or higher than 2400 V. In order to cause the electric potential of the endless belt 7 after the electric-charge removal is performed thereon to be equal to or higher than 1380 V, inferring from the characteristics shown in FIG. 18, it is necessary to cause the DC offset voltage of the electric-charge removing brush 13 to be equal to or higher than 1570 V. In order to cause the electric potential of the endless belt 7 after the electric-charge removal is performed thereon to be equal to or higher than 400 V, inferring from the characteristics shown in FIG. 18, it is necessary to cause the DC offset voltage of the electric-charge removing brush 13 to be equal to or higher than 440 V.

Thus, in order to cause the electric potential of the endless belt 7 before the toner transfer to be 1900 V, which is the minimum value in the case where the electric potential of the transfer roller 25 of the electrostatic recording unit 10-1 can have a minus polarity when the printing is performed on a film for an OHP, in the case where the ACp-p of the electric-charge removing brush 13 is 0.75 V and the DC offset voltage of the brush 13 is equal to or higher than 2860 V, the electric potential of the electric charging voltage of the electric charging roller 9 is to be equal to or higher than 500 V.

That is, the belt voltage generating circuit 64 is to generate the voltage equal to or higher than 500 V as the second electric charging voltage VBT2, and the electric-charge-removing-brush voltage generating circuit 65 is to generate the voltage having the ACp-p of 0.75 V and the DC offset voltage equal to or higher than 2860 V as the second electric-charge removing voltage VBJ2.

In order to cause the electric potential of the endless belt 7 to be 1900 V, which is the minimum value in the case where the electric potential of the transfer roller 25 of the electrostatic recording unit 10-1 can have a minus polarity when the printing is performed on a film for an OHP, in the case where the ACp-p of the electric-charge removing brush 13 is 0.75 V and the DC offset voltage of the brush 13 is equal to or higher than 2400 V, the electric potential of the electric charging voltage of the electric charging roller 9 is to be equal to or higher than 1000 V.

That is, the belt voltage generating circuit 64 is to generate the voltage equal to or higher than 1000 V as the second electric charging voltage VBT2, and the electric-charge-removing-brush voltage generating circuit 65 is to generate the voltage having the ACp-p of 0.75 V and the DC offset voltage equal to or higher than 2400 V as the second electric-charge removing voltage VBJ2.

In order to cause the electric potential of the endless belt 7 to be 1900 V, which is the minimum value in the case where the electric potential of the transfer roller 25 of the electrostatic recording unit 10-1 can have a minus polarity when the printing is performed on a film for an OHP, in the case where the ACp-p of the electric-charge removing brush 13 is 0.75 V and the DC offset voltage of the brush 13 is equal to or higher than 1570 V, the electric potential of the electric charging voltage of the electric charging roller 9 is to be equal to or higher than 2000 V.

That is, the belt voltage generating circuit 64 is to generate the voltage equal to or higher than 2000 V as the second electric charging voltage VBT2, and the electric-charge-removing-brush voltage generating circuit 65 is to generate the voltage having the ACp-p of 0.75 V and the DC offset voltage equal to or higher than 1570 V as the second electric-charge removing voltage VBJ2.

In order to cause the electric potential of the endless belt 7 to be 1900 V, which is the minimum value in the case where the electric potential of the transfer roller 25 of the electrostatic recording unit 10-1 can have a minus polarity when the printing is performed on a film for an OHP, in the case where the ACp-p of the electric-charge removing brush 13 is 0.75 V and the DC offset voltage of the brush 13 is equal to or higher than 440 V, the electric potential of the electric charging voltage of the electric charging roller 9 is to be equal to or higher than 3000 V.

That is, the belt voltage generating circuit 64 is to generate the voltage equal to or higher than 3000 V as the second electric charging voltage VBT2, and the electric-charge-removing-brush voltage generating circuit 65 is to generate the voltage having the ACp-p of 0.75 V and the DC offset voltage equal to or higher than 440 V as the second electric-charge removing voltage VBJ2.

In the endless belt 7, the electric-charge density of the belt is determined as the product of the electrostatic capacity of the belt and the electric potential of the belt. That is, $$\text{(electric-charge density of the belt) } (\mu/m^2) = \text{(electrostatic capacity of the belt) } (\mu F/m^2) \times \text{(electric potential of the belt) (V)}$$

Accordingly, for example, when the electric potential of the endless belt 7 is +1000 V, assuming that the electrostatic capacity of the belt is 0.62 $\mu F/m^2$, the surface electric-charge density of the endless belt 7 is 620 $\mu C/m^2$ obtained from the following equation:

$$0.62 \times 1000 = 620 (\mu C/m^2)$$

Thus, it is possible to express the electric potential of the endless belt 7 by the surface electric-charge density thereof. As mentioned above, it is necessary that the electric potential of the endless belt 7 when the printing is performed on ordinary paper be equal to or higher than 1000 V. For a recording medium having the volume resistivity lower than $10^{14}$ Ω such as ordinary paper, the surface electric-charge density should be equal to or higher than 620 $\mu C/m^2$. Further, it is necessary that the electric potential of the endless belt 7 when the printing is performed on a film for an OHP be equal to or higher than 1900 V. For a recording medium having the volume resistivity equal to or higher than $10^{14}$ Ω such as a film for an OHP, the surface electric-charge density should be equal to or higher than 1178 $\mu C/m^2$ (0.62×1900=1178).

A method of setting the electric potential of the transfer roller 25 in each of the electrostatic recording units 10-1 through 10-4 will now be described.

The setting is performed such that the transfer voltages VTY1 through VTY3, VTM1 through VTM3, VTC1 through VTC3, and VTK1 through VTK4 to be applied to the respective transfer rollers 25 increase in the order of the arrangement of the electrostatic recording units 10-1 through 10-4.

For example,

VTY1<VTM1<VTC1<VTK1

VTY2<VTM2<VTC2<VTK2

VTY3<VTM3<VTC3<VTK3

Thus, the transfer voltage to be applied to the transfer roller 25 is higher for the electrostatic recording unit which performs the toner transfer later. Thereby, it is possible to transfer the toner image without suffering influence of the toner image transferred precedingly. Thus, it is possible to surely transfer the toner image on the toner image transferred precedingly. As a result, it is possible to improve the quality of the printed image.

Specifically, the electric potentials of the transfer rollers 25 of the electrostatic recording units 10-1 through 10-4 are determined as follows:

For example, it is assumed that the volume resistivity of the endless belt 7 is $10^{13}$ through $10^{15}$ Ω, the surface resistivity of the belt 7 (obverse side) is $10^{15}$ through $10^{17}$ Ω, the surface resistivity of the belt 7 (reverse side) is $10^{15}$ through $10^{17}$ Ω, and the electrostatic capacity of the belt 7 is 0.62 through 0.75 $\mu F/m^2$; the volume resistivity of each transfer roller 25 is $9\times10^3$ Ω, $3\times10^4$ Ω, $1\times10^5$ Ω, and the volume resistivity of the electric charging roller 9 is $2\times10^6$ through $9\times10^6$ Ω; the volume resistivity of the electric-charge removing brush 13 is $1\times10^4$ through $7\times10^6$ Ω; each toner is charged to have a minus polarity of electric charges; and further, as recording media, ordinary paper having the volume resistivity of $10^7$ through $10^9$ Ω, the surface resistivity of $10^9$ through $10^{11}$ Ω, and the relative permittivity of 2 through 3.5; and a film for an OHP having the volume resistivity of $10^{15}$ through $10^{16}$ Ω, the surface resistivity of $10^9$ through $10^{16}$ Ω, and the relative permittivity of 2 through 3.5 are used. The transfer efficiencies with respect to the transfer electric potentials of the transfer rollers 25 of the respective electrostatic recording units 10-1 through 10-4 in the above-described conditions will now be described.

FIGS. 19A, 19B and 19C show the characteristics of the toner transfer efficiencies with respect to the transfer voltages when the printing is performed on ordinary paper. FIG. 19A shows the characteristics of the toner transfer efficiencies with respect to the transfer voltages VTY applied to the transfer roller 25 of the electrostatic recording unit 10-1. FIG. 19B shows the characteristics of the toner transfer efficiencies with respect to the transfer voltages VTM applied to the transfer roller 25 of the electrostatic recording unit 10-2 when −500 V is applied to the transfer roller 25 of the electrostatic recording unit 10-1. FIG. 19C shows the characteristics of the toner transfer efficiencies with respect to the transfer voltages VTC applied to the transfer roller 25 of the electrostatic recording unit 10-3 when −500 V is applied to the transfer roller 25 of the electrostatic recording unit 10-1, and +100 V is applied to the transfer roller 25 of the electrostatic recording unit 10-2. The characteristics shown in FIGS. 19A, 19B and 19C are those when 1700 V is applied to the electric charging roller 9 and 2000 V is applied to the electric-charge removing brush 13.

FIG. 19A shows the toner transfer efficiencies with respect to the transfer voltage in the electrostatic recording unit 10-1 when the toner of one color, yellow, is transferred. As shown in the figure, using the electrostatic recording unit 10-1, the toner transfer efficiency exceeds 80% when the transfer voltage applied to the transfer roller 25 is approximately −1000 V.

In FIG. 19B, ● shows the toner transfer efficiencies with respect to the transfer voltage in the electrostatic recording unit 10-2 when the toner of one color, magenta, is transferred, and □ shows the toner transfer efficiencies with respect to the transfer voltage in the electrostatic recording unit 10-2 when the toner of magenta is transferred to be overlaid on the toner of yellow. As shown in the figure, for the electrostatic recording unit 10-2, which is arranged next to the electrostatic recording unit 10-1, the transfer efficiency exceeds 80% when the transfer voltage applied to the transfer roller 25 is equal to or higher than approximately −500 V.

In FIG. 19C, ● shows the toner transfer efficiencies with respect to the transfer voltage in the electrostatic recording unit 10-3 when the toner of one color, cyan, is transferred, □ shows the toner transfer efficiencies with respect to the transfer voltage in the electrostatic recording unit 10-3 when the toner of cyan is transferred so as to be overlaid on the toner of yellow, ▲ shows the transfer efficiencies with respect to the transfer voltage in the electrostatic recording unit 10-3 when the toner of cyan is transferred so as to be overlaid on the toner of magenta, and x shows the transfer efficiencies with respect to the transfer voltage in the electrostatic recording unit 10-3 when the toner of cyan is transferred so as to be overlaid on the toner of yellow and toner of magenta, the latter having been overlaid on the former. By inferring from the characteristics shown in FIG. 19C, for the electrostatic recording unit 10-3, which is arranged next to the electrostatic recording units 10-1 and 10-2, the transfer efficiency exceeds 80% when the transfer voltage applied to the transfer roller 25 is equal to or higher than approximately −300 V.

Therefore, when recording is performed in which two colors or three colors are overlaid on each other on ordinary paper, it is possible to cause the toner transfer efficiency to be equal to or higher than 80% as a result of the transfer voltage applied to the transfer roller 25 of the electrostatic recording unit 10-2 being set to be higher than the transfer voltage applied to the transfer roller 25 of the electrostatic recording unit 10-1, and the transfer voltage to be applied to the transfer roller 25 of the electrostatic recording unit 10-3 being set to be higher than the transfer voltage applied to the transfer roller 25 of the electrostatic recording unit 10-2.

For example, when the printing is performed on ordinary paper, the transfer voltage to be applied to the transfer roller 25 of the electrostatic recording unit 10-2 is set to be higher than the transfer voltage applied to the transfer roller 25 of the electrostatic recording unit 10-1 by 500 V, and the transfer voltage applied to the transfer roller 25 of the electrostatic recording unit 10-3 is set to be higher than the transfer voltage applied to the transfer roller 25 of the electrostatic recording unit 10-2 by 200 V. As a result, a recording result of printing with high tone is obtained.

FIGS. 20A, 20B and 20C show the characteristics of the transfer efficiencies with respect to the transfer voltages when the printing is performed on a film for an OHP. FIG. 20A shows the characteristics of the toner transfer efficiencies with respect to the transfer voltages VTY applied to the transfer roller 25 of the electrostatic recording unit 10-1. FIG. 20B shows the characteristics of the toner transfer efficiencies with respect to the transfer voltages VTM applied to the transfer roller 25 of the electrostatic recording unit 10-2 when −500 V is applied to the transfer roller 25 of the electrostatic recording unit 10-1. FIG. 20C shows the characteristics of the toner transfer efficiencies with respect to the transfer voltages VTC applied to the transfer roller 25 of the electrostatic recording unit 10-3 when −500 V is applied to the transfer roller 25 of the electrostatic recording unit 10-1 and +500 V is applied to the transfer roller 25 of the electrostatic recording unit 10-2. The characteristics shown in FIGS. 20A, 20B and 20C are those when 2500 V is applied to the electric charging roller 9 and 2700 V is applied to the electric-charge removing brush 13.

FIG. 20A shows the toner transfer efficiencies with respect to the transfer voltage in the electrostatic recording unit 10-1 when the toner of one color, yellow, is transferred. As shown in the figure, for the electrostatic recording unit 10-1, the transfer efficiency exceeds 80% through a wide range of the transfer voltage.

In FIG. 20B, ● shows the toner transfer efficiencies with respect to the transfer voltage in the electrostatic recording unit 10-2 when the toner of one color, magenta, is transferred, and □ shows the toner transfer efficiencies with respect to the transfer voltage in the electrostatic recording unit 10-2 when the toner of magenta is transferred so as to be overlaid on the toner of yellow. As shown in the figure, for the electrostatic recording unit 10-2, which is arranged next to the electrostatic recording unit 10-1, the toner transfer efficiency exceeds 80% when the transfer voltage applied to the transfer roller 25 is equal to or higher than approximately +100 V.

In FIG. 20C, ● shows the transfer efficiencies with respect to the transfer voltage in the electrostatic recording unit 10-3 when the toner of one color, cyan, is transferred, □ shows the toner transfer efficiencies with respect to the transfer voltage in the electrostatic recording unit 10-3 when the toner of cyan is transferred so as to be overlaid on the toner of yellow, ▲ shows the toner transfer efficiencies with respect to the transfer voltage in the electrostatic recording unit 10-3 when the toner of cyan is transferred so as to be overlaid on the toner of magenta, and x shows the toner transfer efficiencies with respect to the transfer voltage in the electrostatic recording unit 10-3 when the toner of cyan is transferred so as to be overlaid on the toner of yellow and toner of magenta, the latter having been overlaid on the former. As shown in FIG. 20C, for the electrostatic recording unit 10-3, which is arranged next to the electrostatic recording units 10-1 and 10-2, the transfer efficiency exceeds 80% when the transfer voltage applied to the transfer roller 25 is equal to or higher than approximately +1000 V.

Therefore, when recording is performed in which two colors or three colors are overlaid on each other on a film for OHP, it is possible to cause the toner transfer efficiency to be equal to or higher than 80% as a result of the transfer voltage applied to the transfer roller 25 of the electrostatic recording unit 10-2 being set to be higher than the transfer voltage to be applied to the transfer roller 25 of the electrostatic recording unit 10-1, and the transfer voltage to be applied to the transfer roller 25 of the electrostatic recording unit 10-3 being set to be higher than the transfer voltage to be applied to the transfer roller 25 of the electrostatic recording unit 10-2.

For example, when the printing is performed on a film for an OHP, the transfer voltage applied to the transfer roller 25 of the electrostatic recording unit 10-2 is set to be higher than the transfer voltage applied to the transfer roller 25 of the electrostatic recording unit 10-1 by 800 V, and the transfer voltage applied to the transfer roller 25 of the electrostatic recording unit 10-3 is set to be higher than the transfer voltage applied to the transfer roller 25 of the electrostatic recording unit 10-2 by 600 V. Thereby, a recording result of printing with high tone is obtained.

In the above-described embodiment, the electrostatic recording units 10-1 through 10-4 are arranged so that the toner colors are arranged in the order of yellow, magenta, cyan and black. However, the setting of the transfer voltages are not limited to the above-mentioned color arrangement.

Further, the present invention is not limited to the above-described embodiment, and variations and modifications may be made without departing from the scope of the present invention.

The contents of the basic Japanese Patent Application No. 9-326810, filed on Nov. 27, 1997, are hereby incorporated by reference.

What is claimed is:

1. An image forming apparatus, comprising:

developing means for forming a toner image, which corresponds to a recording image, with a toner which has been electrically charged to a predetermined electrical potential; and transfer means, to which an electric potential, different from the electric potential of the toner image, is applied, for transferring the toner image onto a recording medium;

first transfer-electric-potential applying means for applying an electric potential to said transfer means;

carrying means for carrying the recording medium so as to cause the recording medium to pass said transfer means; and second transfer-electric-potential applying means for applying an electric potential to the recording medium and said carrying means;

wherein the electric potentials applied by said first transfer-electric-potential applying means and said second transfer-electric-potential applying means are such that the necessary transfer electric potential is allotted between said first transfer-electric-potential applying means and said second transfer-electric-potential applying means.

2. The image forming apparatus, according to claim 1, wherein said first transfer-electric-potential applying means sets the transfer electric potential of a polarity the same as the polarity of the toner.

3. The image forming apparatus, according to claim 1, further comprising electric potential control means for controlling, in accordance with the resistance of the recording medium, the transfer electric potential which is applied to said transfer means by said first transfer-electric-potential applying means and the predetermined electric potential which is applied to the recording medium and said carrying means by said second transfer-electric-potential applying means.

4. The image forming apparatus according to claim 1, wherein said second transfer-electric-potential applying means comprises:

electric-charge removing means for removing the electric charges from said carrying means;

electric charging means for electrically charging said carrying means from which the electric charges have been removed by said electric-charge removing means, and electrically charging the recording medium; and electric charging control means for controlling the electric-charge removal electric potential of said electric-charge removing means and the electric-charging electric potential of said electric charging means.

5. The image forming apparatus, according to claim 4, wherein said electric charging control means causes the electric potential of said carrying means to have a different electric potential in accordance with whether the volume resistivity of said recording medium is lower than $10^{14}$ (Ω) or is equal to or higher than $10^{14}$ (Ω).

6. The image forming apparatus, according to claim 5, wherein and said electric charging control means causes said carrying means to be electrically charged so that the surface electric-charge density thereof is equal to or higher than 620 ($\mu C/m^2$) when the volume resistivity of the recording medium is lower than $10^{14}$ (Ω), and said electric charging control means causes said carrying means to be electrically charged so that the surface electric-charge density thereof is equal to or higher than 1178 ($\mu C/m^2$) when the volume resistivity of the recording medium is equal to or higher than $10^{14}$ (Ω).

7. An image forming apparatus, comprising:

a plurality of recording units, each comprising:

developing means for forming a toner image corresponding to a recording image with toner charged to have a predetermined electric potential;

transfer means, which faces said developing means via a recording medium and to which an electric potential different from the electric potential of the toner image is applied, for transferring the toner image onto the recording medium, said plurality of recording units transferring the plurality of toner images onto the recording medium so as that the plurality of toner images are overlaid on each other;

fixing means for fixing the plurality of toner images transferred onto the recording medium so that the plurality of toner images are overlaid on each other; and transfer-electric-potential applying means in which the electric potentials to be applied to the transfer means of said plurality of recording units are set such that the difference between the electric potential of the transfer means and the electric potential of the toner increases sequentially in the order of the arrangement of said plurality of recording units, wherein said transfer-electric-potential applying means comprises:

first transfer-electric-potential applying means for applying the electric potentials to said transfer means;

carrying means for carrying the recording medium and thereby causing said recording medium to pass said transfer means; and second transfer-electric-potential applying means for applying an electric potential to the recording medium and carrying means, wherein the electric potentials applied by said first transfer-electric-potential applying means and said second transfer-electric-potential applying means are such that the necessary transfer electric potential is allotted between said first transfer-electric-potential applying means and said second transfer-electric-potential applying means.

8. The image forming apparatus, according to claim 7, further comprising electric potential control means for controlling, in accordance with the resistance of the recording medium, the transfer electric potential which is applied to said transfer means by said first transfer-electric-potential applying means and the predetermined electric potential which is applied to the recording medium and said carrying means by said second-transfer-electric potential applying means.

9. The image forming apparatus according to claim 7, wherein said second transfer-electric-potential applying means comprises:

electric-charge removing means for removing the electric charges from said carrying means;

electric charging means for charging said carrying means for electrically charging said carrying means from which the electric charges have been removed by said electric-charge removing means, and electrically charging the recording medium; and electric charging control means for controlling the electric-charge removal electric potential of said electric-charge removing means and the electric charging electric potential of said electric charging means.

10. The image forming apparatus, according to claim 9, wherein said electric charging control means causes the electric potential of said carrying means to have a different electric potential whether the volume resistivity of said recording medium is lower than $10^{14}$ (Ω) or is equal to or higher than $10^{14}$ (Ω).

11. The image forming apparatus, according to claim 10, wherein and said electric charging control means cause said carrying means to be electrically charged so that the surface electric-charge density is equal to or higher than 620 ($\mu C/m^2$) when the volume resistivity of the recording medium is lower than $10^{14}$ (Ω), and said electric charging control means cause said carrying means to be electrically charged so that the surface electric-charge density is equal to or higher than 1178 ($\mu C/m^2$) when the volume resistivity of the recording medium is equal to or higher than $10^{14}$ (Ω).

12. An image forming apparatus, comprising:

a developing portion forming a toner image, which corresponds to a recording image, with a toner which has been electrically charged to a predetermined electrical potential; and a transfer portion, to which an electric potential, different from the electric potential of the toner image, is applied, transferring the toner image onto a recording medium;

a first transfer-electric-potential applying portion applying an electric potential to said transfer portion;

a carrying portion carrying the recording medium so as to cause the recording medium to pass said transfer portion; and a second transfer-electric-potential applying portion applying an electric potential to the recording medium and said carrying portion, wherein the electric potential applied by said first transfer-electric-potential applying portion and said second transfer-electric-potential applying portion are such that the necessary transfer electric potential is allotted between said first transfer-electric-potential applying portion and said second transfer-electric-potential applying portion.

13. The image forming apparatus, according to claim 12, wherein said first transfer-electric-potential applying portion sets the transfer electric potential of a polarity the same as the polarity of the toner.

14. The image forming apparatus, according to claim 12, further comprising an electric potential control portion controlling, in accordance with the resistance of the recording medium, the transfer electric potential which is applied to said transfer portion by said first transfer-electric-potential applying portion and the predetermined electric potential which is applied to the recording medium and said carrying portion by said second transfer-electric-potential applying portion.

15. The image forming apparatus according to claim 12, wherein said second transfer-electricpotential applying portion comprises:

an electric-charge removing portion removing the electric charges from said carrying portion;

an electric charging portion electrically charging said carrying portion from which the electric charges have been removed by said electric-charge removing portion, and electrically charging the recording medium; and electric charging control portion for controlling the electric-charge removal electric potential of said electric-charge removing portion and the electric-charging electric potential of said electric charging portion.

16. The image forming apparatus, according to claim 15, wherein said electric charging control portion causes the electric potential of said carrying portion to have a different electric potential in accordance with whether the volume resistivity of said recording medium is lower than $10^{14}$ (Ω) or is equal to or higher than $10^{14}$ (Ω).

17. The image forming apparatus, according to claim 16, wherein and said electric charging control portion causes said carrying portion to be electrically charged so that the surface electric-charge density thereof is equal to or higher than 620 ($\mu C/m^2$) when the volume resistivity of the recording medium is lower than $10^{14}$ (Ω), and said electric charging control portion causes said carrying portion to be electrically charged so that the surface electric-charge density thereof is equal to or higher than 1178 ($\mu C/m^2$) when the volume resistivity of the recording medium is equal to or higher than $10^{14}$ (Ω).

18. An image forming apparatus, comprising:

a plurality of recording units, each comprising:

a developing portion forming a toner image corresponding to a recording image with toner charged to have a predetermined electric potential;

a transfer portion, which faces developing means via a recording medium and to which an electric potential different from the electric potential of the toner image is applied, transferring the toner image onto the recording medium, said plurality of recording units transferring the plurality of toner images to the recording medium so as that the plurality of toner images are overlaid on each other;

a fixing portion fixing the plurality of toner images transferred onto the recording medium so that the plurality of toner images are overlaid on each other; and a transfer-electric-potential applying portion by which the electric potentials to be applied to the transfer portions of said plurality of recording units are set such that the difference between the electric potential of said transfer portion and the electric potential of the toner increases sequentially in the order of the arrangement of said plurality of recording units, wherein said second transfer-electric-potential applying portion comprises:

first transfer-electric-potential applying portions applying the electric potentials to said transfer portions;

a carrying portion carrying the recording medium and thereby causing said recording medium to pass said transfer portions; and a second transfer-electric-potential applying portion applying an electric potential to the recording medium and said carrying portion, wherein the electric potentials applied by said first transfer-electric-potential applying portions and said second transfer-electric-potential applying portion are such that the necessary transfer electric potential is allotted between said first transfer-electric-potential applying portions and said second transfer-electric-potential applying portion.

19. The image forming apparatus, according to claim 18, further comprising an electric potential control portion controlling, in accordance with the resistance of the recording medium, the transfer electric potential which is applied to said transfer portion by said first transfer-electric-potential applying portion and the predetermined electric potential which is applied to the recording medium and said carrying portion by said second transfer-electric-potential applying portion.

20. The image forming apparatus according to claim 18, wherein said second transfer-electric-potential applying portion comprises:

an electric-charge removing portion removing the electric charges from said carrying portion;

an electric charging portion charging said carrying portion for electrically charging said carrying portion from which the electric charges have been removed by said electric-charge removing portion, and electrically charging the recording medium; and an electric charging control portion controlling the electric-charge removal electric potential of said electric-charge removing portion and the electric charging electric potential of said electric charging portion.

21. The image forming apparatus, according to claim 20, wherein said electric charging control portion causes the electric potential of said carrying portion to have a different electric potential whether the volume resistivity of said recording medium is lower than $10^{14}$ (Ω) or is equal to or higher than $10^{14}$ (Ω).

22. The image forming apparatus, according to claim 21, wherein and said electric charging control portion causes said carrying portion to be electrically charged so that the surface electric-charge density is equal to or higher than 620 ($\mu C/m^2$) when the volume resistivity of the recording medium is lower than $10^{14}$ (Ω), and said electric charging control portion cause said carrying portion to be electrically charged so that the surface electric-charge density is equal to or higher than 1178 ($\mu C/m^2$) when the volume resistivity of the recording medium is equal to or higher than $10^{14}$ (Ω).

* * * * *